US009681220B2

(12) United States Patent
Delikaris-Manias et al.

(10) Patent No.: US 9,681,220 B2
(45) Date of Patent: Jun. 13, 2017

(54) METHOD FOR SPATIAL FILTERING OF AT LEAST ONE SOUND SIGNAL, COMPUTER READABLE STORAGE MEDIUM AND SPATIAL FILTERING SYSTEM BASED ON CROSS-PATTERN COHERENCE

(71) Applicant: AALTO-KORKEAKOULUSÄÄTIÖ, Espoo (FI)

(72) Inventors: Symeon Delikaris-Manias, Helsinki (FI); Ville Pulkki, Espoo (FI)

(73) Assignee: AALTO-KORKEAKOULUSÄÄTIÖ, Espoo (FI)

( * ) Notice: Subject to any disclaimer, the term of this patent is extended or adjusted under 35 U.S.C. 154(b) by 0 days.

(21) Appl. No.: 14/648,379

(22) PCT Filed: Nov. 29, 2013

(86) PCT No.: PCT/IB2013/060507

§ 371 (c)(1),
(2) Date: May 29, 2015

(87) PCT Pub. No.: WO2014/083542

PCT Pub. Date: Jun. 5, 2014

(65) Prior Publication Data

US 2015/0304766 A1 Oct. 22, 2015

(30) Foreign Application Priority Data

Nov. 30, 2012 (EP) ..... 12194934

(51) Int. Cl.
*H04R 5/00* (2006.01)
*H04R 3/00* (2006.01)
(Continued)

(52) U.S. Cl.
CPC ..... *H04R 1/32* (2013.01); *G10L 21/0216* (2013.01); *H04R 1/08* (2013.01); *H04R 3/00* (2013.01);
(Continued)

(58) Field of Classification Search
CPC .. H04R 3/005; H04R 1/406; H04R 2201/403; H04R 2430/21; H04R 3/04;
(Continued)

(56) References Cited

U.S. PATENT DOCUMENTS 9,100,734 B2 * 8/2015 Visser ..... G10L 21/0272

FOREIGN PATENT DOCUMENTS

WO WO 2007106399 9/2007

OTHER PUBLICATIONS

International Search Report and Written Opinion in PCT Application PCT/IB32013/060507, EPO, Mar. 6, 2014.
(Continued)

*Primary Examiner* — Paul S Kim
*Assistant Examiner* — Norman Yu

(57) ABSTRACT

Method for spatial filtering of at least one sound signal (M0; W(n)) includes the steps of: generation of a first, a second and a third captured sound signal by capturing of the respective sound signals by microphones characterized by directivity patterns of different orders; performing a short-time Fourier transformation of the captured, sound signal s; measuring a cross-pattern correlation or a cross-pattern coherence towards a desired direction ([phi]); calculation of a gain factor (G+) using a cross-pattern correlation based on time-averaged correlation or coherence between the first captured sound signal and the second captured sound signal; and applying the gain factor (G+) to the corresponding time-frequency positions in the third captured sound, signal
(Continued)

(2.3; M0; W(n)). Independent patent claims also for a system and computer readable storage medium.

26 Claims, 9 Drawing Sheets

(51) Int. Cl.
*H04R 1/32* (2006.01)
*G10L 21/0216* (2013.01)
*H04R 1/08* (2006.01)
*G10L 21/0264* (2013.01)

(52) U.S. Cl.
CPC *G10L 21/0264* (2013.01); *G10L 2021/02166* (2013.01); *H04R 3/005* (2013.01); *H04R 2410/01* (2013.01)

(58) Field of Classification Search
CPC ..... H04R 1/1083; H04R 2201/401; H04R 2430/23; H04R 1/32; H04R 2201/405; H04R 2410/01; H04R 2430/20; H04R 25/407; H04R 29/004; H04R 3/00; H04R 5/027; G10L 2021/02166
USPC ..... 381/92, 122, 94.3, 97, 98, 113, 17, 26, 381/71.1
See application file for complete search history.

(56) References Cited

OTHER PUBLICATIONS

International Preliminary Report in PCT Application PCT/IB32013/060507, EPO, Mar. 2, 2015.
Reply to International Search Report and Written Opinion in PCT Application PCT/IB32013/060507, Vaisanen, Jan. 12, 2015.
Simulations of second order microphones in audio coding, Simeon Delikaris-Manias Jan. 1, 2012, pp. 1-6, URL: http://hal.carchives-ouvertes.fr/docs/oo/61/67/63/PDF/report.pdf, pp. 4-5, figure 2.
Cross Pattern Coherence Algorithm for Spatial Filtering Applications Utilizing Microphone Arrays, Delikaris-Manias et al., Nov. 1, 2013, IEEE transactions on Audio, Speech and Language Processing, vol. 21, No. 12, abstract, sections I-III, figures 1, 7.
Acoustic source detection and localization based on wavefield decomposition using circular microphone arrays, Teutsch et al.., J. Accoust. Soc. Am. vol. 120, No. 5, Aug. 8, 2006, pp. 2724-2736.
Modifying the Directional Responses of a Coincident Pair of Microphones by Postprocessing, Faller, J. Audio Eng. Soc., vol. 56, No. 10, Oct. 2008, pp. 810-822.
Analysis and Design of Spherical Microphone Arrays, Rafaely, IEEE Transactions on Speech and Audio Processing, vol. 13, No. 1, Jan. 2005, pp. 135-143.
A Highly Directive 2-Capsule Based Microphone System, Faller, Audio Engineering Society, Convention Paper 7313 Presented at the 123rd convention Oct. 5, 2007, p. s1-s9.
A Spatial Filtering Approach for Directional Audio Coding, Kallinger et al., Audio Engineering Society, Convention Paper 7653 Presented at the 126th Convention, May 7, 2009, pp. 1-10.
Cross Pattern Coherence Algorithm for Spatial Filtering Applications Utilizing Microphone Arrays, Delikaris-Manias et al., IEEE Transactions on Audio, Speech and Language Processing, vol. 21, No. 11, Nov. 2013, pp. 2356-2366.
Factorial Models and Refiltering for Speech Separation and Denoising, Rowels, Eurospeech Sep. 2003—Geneva, pp. 1009-1012.
Fast Deconvolution of Multichannel Systems Using Regularization, Kirkeby et al, IEEE Transactions on Speech and Audio Processing, vol. 6, No. 2, Mar. 1998, pp. 189-195.
3D Sound Field Recording with Higher Order Ambisonics—Objective Measurements and Validation of 4th Order Spherical Microphones, Moreau et al., Audio Engineering Society Convention Paper Presented at the 120 Convention May 20, 2006, pp. 1-24.
Objective Prediction of the Sound Quality of Music Processed by an Adaptive Feedback Canceller, Manders et al., IEEE Transactions on Audio, Speech and Language Processing, vol. 20, No. 6, Aug. 2012, pp. 1734-1744.
Obtaining a Highly Directive Center Channel from Coincident Stereo Microphone Signals, Audio Engineering Society Convention Paper 7380 Presented at the 124th Convention, May 17, 2008, pp. 1-7.
Optimal Real-Weighted Beamforming With Application to Linear and Spherical Arrays, Tourbabin et al., IEEE Transactions on Audio, Speech and Language Processing, vol. 20, No. 9, Nov. 2012, pp. 2575-2585.
Digital Filter Design for Inversion Problems in Sound Reproduction, Kirkeby et al., J. Audio Eng. Soc., vol. 47, No. 7/8, Jul./Aug. 1999, pp. 583-595.
Reproducing Applause-Type Signals with Directional Audio Coding, Laitinen et al., J. Audio Eng. Soc., vol. 59, No. ½, Jan./Feb. 2011, pp. 29-43.
Spatial Filtering Using Directional Audio Coding Parameters, Kallinger et al., IEEE ICASSP 2009, pp. 217-220.
Spatial Sound Reproductions with Directional Audio Coding, Pulkki, J. Audio Eng. Soc., vol. 55, No. 6, Jun. 2007, pp. 503-516.
Techniques for Synthetic Reconfiguration of Microphone Arrays, J. Audio Eng. Soc., vol. 59, No. 6, Jun. 2011, pp. 404-418.
Further Investigations of High Order Ambisonics and Wavefield Synthesis for Holophonic Sound Imaging, Daniel et al., Audio Engineering Society Convention Paper 5788 Presented at the 114th Convention, Mar. 22, 2003.
Planar Microphone Array Processing for the Analysis and Reproduction of Spatial Audio using Directivity Audio Coding, Schultz-Amling et al., Audio Engineering Society Convention Paper Presented at the 124th Convention, May 17, 2008.
Earl G. Williams, "Fourier Acoustics: Sound Radiation and Nearfield Acoustical Holography", Academic Press, Jun. 30, 1999, pp. 190-197.
A. Ben-Israel and Thomas N.E. Greville, "Generalized Inverses: Theory and Applications", Springer, Jun. 16, 2003 p. 212.
] H. Teutsch, "Modal Array Signal Processing: Principles and Applications of Acoustic Wavefield Decomposition", Berlin Heidelberg: Springer-Verlag, 2007. pp. 149-157.
M. Brandstein and D. Ward, "Microphone Arrays", New York: Springer, 2001. pp. 169-170.
S. L. Gay and J. Benesty, "Acoustic Signal Processing fo Telecommunications",Eds. Kluwer Academic Publishers, 2000. pp. 221-234.
Manders, A.J.; Simpson, D.M.; Bell, S.L.; , "Objective Prediction of the Sound Quality of Music Processed by an Adaptive Feedback Canceller," Audio, Speech, and Language Processing, IEEE Transactions on , vol. 20, No. 6, pp. 1734-1745, Aug. 2012.

* cited by examiner

METHOD FOR SPATIAL FILTERING OF AT LEAST ONE SOUND SIGNAL, COMPUTER READABLE STORAGE MEDIUM AND SPATIAL FILTERING SYSTEM BASED ON CROSS-PATTERN COHERENCE

FIELD OF INVENTION

The invention concerns a method for filtering of spatial noise of at least one sound signal, whereby the invention may be implemented as a computer algorithm or a system for filtering spatial noise comprising at least two microphones or an array of microphones.

BACKGROUND OF THE INVENTION

Spaced pressure microphone arrays allow the design of spatial filters that can focus on one specific direction while suppressing noise or interfering sources from other directions, which can be also referred as beamforming. The most basic beamforming approaches are the conventional delay and sum and the filter and sum. Delay and sum beamformer algorithm estimates the time delays of signals received by each microphone of an array and compensates for the time difference of arrival [5]. Narrow directivity patterns can be obtained, but this requires a large spacing between the microphones and a large number of microphones. An even frequency response for all audible frequencies can be created by using the filter and sum technique.

In international patent application published under publication number WO 2007/106399 A2, a directional microphone array having at least two microphones generates forward and backward cardioid signals from two omnidirectional microphone signals. An adaptation factor is applied to the backward cardioid signal, and the resulting adjusted backward cardioid signal is subtracted from the forward cardioid signal to generate a first-order output audio signal corresponding to a beam pattern having no nulls for negative values of the adaptation factor. After low-pass filtering, it is proposed to apply spatial noise suppression to the output audio signal. Time-variant methods have been proposed to combine the microphones optimally to minimize the level of unwanted sources while retaining the signal arriving from the desired direction. One of the most well known techniques in adaptive beamforming is the Minimum Variance Distortionless Response (MVDR), based on minimizing the power of the output while preserving the signal from the look direction by employing a set of weights and placing nulls at the directions of the interferes [6]. Such beamformers require still relatively high number of microphones in a spatial arrangement with considerable dimensions.

A closely-spaced microphone array technique can also be used for beamforming, where microphone patterns of different orders are derived [7]. In that technique, the microphones are summed together in same or opposite phase with different gains and frequency equalization, where typically microphone signals having directivity patterns following the spherical harmonics of different orders are targeted. Unfortunately, typically the response has tolerable quality only in a limited frequency window; at low frequencies the system suffers from amplification of the self noise of microphones and at high frequencies the directivity patterns are deformed.

These beamforming techniques do not assume anything about the signals of the sources. Recently some techniques have been proposed, which assume that the signals arriving from different directions to the microphone array are sparse in time-frequency domain, i.e., one of the sources is dominant at one time-frequency position [19]. Each time-frequency frame is then attenuated or amplified according to spatial parameters analyzed for corresponding time-frequency position, which essentially assembles the beam. It is clear that such methods may produce distortion to the output, however, the assumption is that the distortion is most prominent with weakest time-frequency slots of the signals making the artifact inaudible or at least tolerable.

In such techniques a microphone array consisting of two cardioid capsules facing opposite directions has been proposed in [15] and [16]. Correlation measures are used between the cardioid capsules and Wiener filtering is used to reduce the level of coherent sound in one of the microphone signals. This produces a directive microphone signal, whose beam width can be controlled. An inherent result is that the width varies depending on the sound field. For example, with few speech sources in relatively anechoic conditions prominent narrowing of the cardioid pattern is obtained. However, with many uncorrelated sources, and in diffuse field, the method does not change the directivity pattern of the cardioid microphone at all. The method is still advantageous, as the number of microphones is low, and the setup does not require large spatial arrangement.

The assumption of the sparsity of the source signals is also utilized in another technique, Directivity Audio Coding (DirAC) [11], which is a method to capture, process and reproduce spatial sound over different reproduction setups. The most prominent direction-of-arrival (DOA) and the diffuseness of sound field are computed or measured as spatial parameters for each time-frequency position of sound. DOA is estimated as the opposite direction of the intensity vector, and the diffuseness is estimated by comparing the magnitude of the intensity vector with total energy. In the original version of DirAC the parameters are utilized in reproduction to enhance audio quality. A variant of DirAC has been used for beamforming [12], where each time-frequency position of sound is gained or attenuated depending on the spatial parameters and a specified spatial filter pattern. In practice, if the DOA of a time-frequency position is far from the desired direction, it is attenuated. Additionally, if the diffuseness is high, the attenuation is made milder as the DOA is considered to be less certain. However, in cases when two sources are active in the same time-frequency position, the analyzed DOA provides erroneous data, and artifacts may occur. In Simeon Delikaris-Manias, Simulations of second order microphones in audio coding, 1 Jan. 2012, pages 1 to 6, XP055104330, as retrieved from the Internet under http://hal.archivesouvertes.fr/docs/00/61/67/63/PDF/report.pdf, a theoretical model for comparing higher order with first order inputs in DirAC analysis has been presented. In the theoretical model, the proposed gain is obtained by computing cross-correlation between two signals normalized with a normalization coefficient. The calculated virtual microphones that contain the signal information may be filtered through DirAC gain and the gain proposed.

SUMMARY OF THE INVENTION

One aim of the invention is to substantially improve the signal-to-spatial noise ratio (SSNR) of an acoustic signal captured by an electric or electronic apparatus such as microphone arrays, even in real-time. Ideally, the spatial noise filtering should not leave acoustic artifacts or give rise to self-noise amplification resulting from the desired spatial noise filtering method. With the term "spatial noise" we in this document mean sounds coming from undesired or unwanted directions. So our aim is not only to improve signal-to-spatial noise ratio but also to enhance spatial noise filtering and suppress other sound sources.

A second aim of the invention is to reduce the number of microphones and similar hardware used for spatial filtering, since nowadays telecom devices in general need to be small and light, in order to minimize the electric and electronic installation efforts as well as improve practicability of the audio device, such as a mobile phone, computer, tablet or similar.

A third aim of the invention is to use established—that is—already existing audio recording devices, to be employed with a minimum or no additional hardware, by implementing the desired method into a computer executable algorithm.

The above mentioned aims are reached by the parametric spatial filtering method according to claim 1, by the computer readable storage medium according to claim 13, when executed in a machine or computer carrying out the method, and by the spatial filtering system according to claim 14.

The dependent claims describe various advantageous aspects and embodiments of the method and of the spatial filtering system. This method and the corresponding algorithm and system utilize Cross Pattern Correlation or even Cross Pattern Coherence (CPC) between microphone signals, in particular of microphone signals with directivity patterns of different orders, as a criterion for focusing in specific directions. The cross-pattern correlation between microphone signals is estimated in time-frequency domain where the similarity of the microphone signals is measured for each time frequency frame. A spatial parameter is extracted which is used to assign gain/attenuation values to a coincidentally captured audio signal.

The parametric method for spatial filtering of at least one sound signal includes the following steps:

- generation of a first captured sound signal by capturing of the at least one sound signal by a first microphone, whereby the first microphone is characterized by a first directivity pattern;
- generation of a second captured sound signal by capturing of the at least one sound signal by a second microphone, whereby the second microphone is characterized by a second directivity pattern; and
- generation of a third captured sound signal by capturing of the at least one sound signal by a third microphone, whereby the third microphone is characterized by a third directivity pattern;
- so that the first microphone, the second microphone and the third microphone constitute one microphone array, characterized by a multiple of directivity patterns of different orders, whereby the first directivity pattern as well as the second directivity pattern and the third directivity pattern constitute respectively one particular directivity pattern of said multiple of directivity patterns of different orders;
- performing a short-time Fourier transformation of the captured sound signals;
- measuring a cross-pattern correlation or a cross-pattern coherence as the correlation or coherence between two of the captured sound signals having the positive-phase maximum in directivity response towards a desired direction in each time frequency position;
- calculation of a gain factor for each time-frequency position using the cross-pattern correlation or the cross-pattern correlation based on time-averaged correlation or coherence between the first captured sound signal and the second captured sound signal having equal phase for the same look direction; and
- applying the gain factor to the corresponding time-frequency positions in the third captured sound signal.

The method can be applied advantageously to systems that use focusing, or background noise suppression such as teleconferencing. Moreover, although this method is rendered for monophonic reproduction, as the beam is aiming towards one direction at a time, it can be extended to multichannel reproduction systems by having multiple beams towards each loudspeaker direction.

Ideally, the cross-pattern correlation or coherence is used to define a correlation measure or coherence measure between the captured signals for the same look direction, where the measure of correlation or coherence is high (exceeds a pre-defined threshold), and/or where the first and second directivity patterns have high sensitivity (exceeding a pre-defined threshold) and/or equal phase for the same look direction. Like this either the proper microphone with the most convenient order of directivity pattern can be selected, for instance a dipole microphone and a quadrupole microphone, to fit the direction of intended operation or alternatively the best look direction of a particular microphone setup can be determined, if the method is carried out for many or all possible look directions in order to define a look direction of optimal signal-to-spatial noise ratio and attenuation performance for the first and second microphone at peak values of the measure of coherence. The coherence between two microphone signals of different orders receives its maximum value when the directivity patterns of the microphones have equal phase and high sensitivity in amplitude towards the arrival direction of the desired signal. Advantageously, a first and second sound signal could be captured and treated simultaneously. The method has proven very effective even to distinguish two independent sound signals. With this quality our method has an advantage over the DirAC technique. Our method can be used to produce much narrower directivity pattern than DirAC.

One embodiment described in the figures could be the first directivity pattern being equivalent to the directivity pattern of first order, and the second directivity pattern being equivalent to the directivity pattern of second order. Due to the different spatial patterns special optimized look directions may be created. The method proves very flexible as to generate optimized (with high SSNR values) look directions in the desired direction.

A normalization of the cross-pattern correlation can be used in such a way to compensate for the magnitudes of the first and second captured signals, for instance, normalized by the energy of both captured signals. The normalization is effective and easy to implement, because it takes into account common features of the multiple order signals.

The gain factor depends on the cross-pattern correlation or the normalized cross-pattern correlation, which is why it should be ideally time averaged to eliminate signal level fluctuations and to provide a smoothing. Like this the systematic error of the gain factor can be reduced regardless what temporal magnitude characteristic the captured sound signal shows.

If the gain factor is half wave rectified in order to obtain a unique beamformer at the desired look direction then the possible artifacts can be avoided since the correlation also would allow negative values, which could be troublesome during a signal synthesis, where the gain factor is applied to a microphone stream or a third captured signal imposing the gain dependent on direction on the stream or the third captured signal, thereby attenuating input from directions with low coherence measure. Therefore the gain factor may very well also be called an attenuation factor, which attenuates unwanted (non-coherent) parts of the captured signals stronger than the coherent ones.

The method may be implemented as a computer programme, an algorithm or machine code, which might be stored on a computer readable storage medium, such as a hard drive, disc, CD, DVD, smart card, USB-stick or similar. This medium would be holding one or more sequence of instructions for a machine or computer to carry out the method according to the invention with at least the first microphone, the second and the third microphone. This would be the easiest and most economic way to employ the method on already existing (tele-) communication systems having at least three or more microphones.

Spatial filtering system based on cross-pattern coherence comprises acoustic streaming inputs for a microphone array with at least a first microphone and a second microphone and an analysis module configured to perform the steps:

- generation of a first captured sound signal by capturing of at least one sound signal by the first microphone, whereby the first microphone is characterized by a first directivity pattern;
- generation of a second captured sound signal by capturing of the at least one sound signal by the second microphone, whereby the second microphone is characterized by a second directivity pattern;
- generation of a third captured sound signal by capturing of the at least one sound signal by a third microphone, whereby the third microphone is characterized by a third directivity pattern;
- so that the first microphone, the second microphone and the third microphone constitute one microphone array, characterized by a multiple of directivity patterns of different orders, whereby the first directivity pattern as well as the second directivity pattern and the third directivity pattern constitute respectively one particular directivity pattern of said multiple of directivity patterns of different orders,
- performing a short-time Fourier transformation of the captured sound signals;
- measuring a cross-pattern correlation or a cross-pattern coherence as the correlation or coherence between two of the captured sound signals having the positive-phase maximum in directivity response towards a desired direction in each time frequency position;
- calculation of a gain factor for each time-frequency position using the cross-pattern correlation or the cross-pattern coherence based on time-averaged correlation or coherence between the first captured sound signal and the second captured sound signal having equal phase for the same look direction; and
- applying the gain factor to the corresponding time-frequency positions in the third captured sound signal.

The system can be adapted to suppress noise in multi-party telecommunication systems or mobile phones with a hands-free option.

The system may further comprise an equalization module equalizing the first captured signal and second captured signal to both have the same phase and magnitude responses before the analysis module calculates the gain factor. This type of equalization is especially advantageous when employed to condition sound signal streams for the proposed inventive spatial filtering method.

The invention is based on insights stemming from the idea of Modal Microphone Array Processing. This technique was chosen to be employed for the mathematical approach of the invention. For known general information of Modal Microphone Array Processing the reader is referred to references [3] and [4]. Relevant for the invention are the zeroth and higher-order signals of the resulting microphone signals for each sample n:

(according to Equation) (1)

where $H_m(n)$ is a matrix containing the signals from each microphone m and $Y_{pq}^{\sigma}(\phi, \theta)$ the spherical harmonic coefficients for azimuth $\phi$ and elevation $\theta$ for the $p^{th}$ order and $q^{th}$ degree. $A_{pq}^{\sigma}$ are the resulting microphone signals. Each spherical harmonic function consists of the gain matrix for each separate microphone. The term $\{[Y_{pq}^{\square}(\phi, \theta)]^T Y_{pq}^{\square}(\phi, \theta)\}^{-1} [Y_{pq}^{\square}(\phi, \theta)]^T$ is the Moore-Penrose inverse matrix of $Y_{pq}^{\square}(\phi, \theta)$ [2]. The encoding process is illustrated in FIG. 1. The real spherical harmonics are given by:

(according to Equation) (2)

(according to Equation) (3)

and $P_{qp}(\cos(\theta))$ are the Legendre functions. In a general fashion these functions have been extensively discussed in [1].

The algorithm according to the invention is simple to implement and offers the capability of coping with interfering sources at different spatial locations with or without the presence of background noise. It can be implemented by using any kind of microphones that are on the same look direction and have the same magnitude and phase response.

The signals obtained from a microphone array are transformed into the time frequency domain through a Fourier Transform, such as a Short Time Fourier Transform (STFT). Given a microphone signal $A_{pq}^{\sigma}(n)$ the corresponding complex time-frequency representation is denoted as $A_{pq}^{\sigma}(k, i)$, where k is the frequency frame and i the time frame.

Equalization of Higher-Order Signals

As mentioned before, the correlation and the coherence are measured between signals originating from different orders of spherical harmonics. For this operation, the output signals from the matrixing process are equalized in a way that the resulting spectra of each order is matched with each other. In other words, the responses need not to be spectrally flat, however, both the phase and the magnitude responses need to be equal in the signals of different orders. This is different from conventional equalization methods, where the microphone signals are equalized according to the direct inversion radial weightings [7] or modified radial weighting when the microphone array is baffled [21]. Such matching is achieved by using a regularized inversion of the radial weightings $W_r$ [7] to control the inversion.

The resulting equalized signals are:

(according to Equation) (4).

The equalizer $EQ_{pq}^{\sigma}(k, i)$ for each sign as is calculated by using a regularization coefficient to control the output [8], [9]:

(according to Equation) (5)

where $\beta$ is the regularization coefficient. The regularization parameter is frequency dependent and specifies the amount of inversion within a frequency region and it can be used to control the power output. A regularization value of order $10^{-6}$ is applied within the frequency limits where the performance is designed to work optimally.

The aim of the method according to the invention is to capture a sound signal originating from one specific direction while attenuating signals from different directions. It employes a spatial filtering technique that reduces background noise and interfering sources from the desired sound source by using a coherence measure. The main idea behind this contribution is that the correlation or coherence between two microphone signals of different orders receives its maximum value when the directivity patterns of the microphones have equal phase and high sensitivity in amplitude towards the arrival direction of the sound signal. In other words, a plane wave signal is captured by carefully selected microphone signals of different orders coherently only in the case when the DOA of the plane wave coincides within the selected direction. In all other cases the correlation/coherence is reduced.

The method/algorithm indicates that for spatial filtering microphone signals bearing the positive phase of their directivity patterns on the same direction should be utilized. The spherical or cylindrical harmonic framework can be used for a straightforward matrixing to derive microphone patterns.

Spatial Parameter Derivation

One important step of the method according to the invention is to compute the cross-pattern correlation Γ between two different microphone signals:

(according to Equation) (6)

where $M^1{}_1(k, i)$ and $M^1{}_2(k, i)$ are the time-frequency representation of separate microphone signals that their directivity patterns have the same look direction. From (6) is clear that Γ(k, i) depends on the magnitudes of the microphone signals, which is not desired as the spatial parameter should depend only on the direction of arrival of the sound. To circumvent this in the present approach a normalization is used to derive a spatial parameter G:

(according to Equation) (7)

where R is the real part of the cross-pattern correlation Γ. In this document we refer with G to the normalized correlation and it is indicated as the spatial parameter of the Cross-Pattern Coherence (CPC) algorithm. In (7), $M_1^{-1}$ and $M_2^{-1}$ are microphone signals with directivity patterns $M_1^{-1}(\psi)$ and $M_2^{-1}(\psi)$ selected in a way that:

(according to Equation) (8)

for n=1 and n=2, $M_0(\psi)$ is the directivity pattern of the signal $M_0$ that will be used as audio signal attenuated selectively in time-frequency domain, $\psi\epsilon[0, 360)$ and $M_1^1(\psi)$, $M_2^1(\psi)$ the directivity patterns of signals $M_1^1$ and $M_2^1$ Equation (8) should be satisfied for all plane waves with direction of arrival of ψ. The normalization process in (7) ensures that with all inputs the computed coherence value is bound within the interval [−1, 1], and that values near unity are obtained only when the signals $M_1^1(k, i)$ and $M_2^1(k, i)$ are equivalent in both phase and magnitude.

As the coherence values near unity imply that there is some sound arriving from the look direction, the values near zero or below it indicate that the sound of analyzed time-frequency frame does not originate from the look direction. By taking this into consideration, a rule might be defined where only the positive part of this lobe is chosen for a unique beamformer at the look direction.

This may be performed as a half wave rectifier. If $M_x$ and $M_y$, where x and y represent the different microphone orders, are identical for one specific direction, then their power spectrum is equal and the value of G is unity. If $M_x$ and $M_y$ are completely uncorrelated, G receives a value of zero. Therefore the interval [0,1] indicates the level of coherence between microphone signals and the higher the coherence the higher the value of G is. Up to this moment we have introduced an attenuation/gain value G that can be used to synthesize the output signal of the proposed spatial filtering technique. The synthesis part would consist of a single output signal S which could be computed using straightforward multiplication of the half-wave rectified function G with a microphone signal $M_0$:

$$S(k,i)=\max(0,G(k,i))M_0(k,i). \quad (9)$$

In order to obtain good sound quality, the signal $M_0$ needs to have a spectrally flat response. The level of self-noise produced by the microphone should also be low. An exemplary solution is to use zeroth-order microphone for this purpose, as available pressure microphones have typically flat magnitude response with tolerable noise level.

Optional Temporal Averaging of the Spatial Parameter

The value of the spatial parameter G for each time frequency frame is calculated according to the correlation/coherence between microphone signals. In a recording from a real sound scenario the levels of sound sources with different directions of arrival may fluctuate rapidly and result in rapid changes in the calculated spatial parameter G. By taking the product of the microphone signal and the spatial parameter in (9), clearly audible artifacts are produced in the output. The main cause is the relatively fast fluctuation of G and the artifact is referred as the bubbling effect. Similar effects have been reported in adaptive feedback cancellation processors used in hearing aids [22], [23] and spatial filtering techniques using DirAC [13]. In order to mitigate these artifacts in the reproduction chain, temporal averaging could be performed in the parameter G. This type of averaging, or smoothing, which is essentially a single-pole recursive filter is defined as:

$$\hat{G}(k,i)=\alpha(k)\max(0,G(k,i))-(1-\alpha(k))\hat{G}(k,i-1) \quad (10)$$

Where $\hat{G}(k, i)$ are the smoothed gain coefficients for a frequency bin k and time bin i and α(k) the smoothing coefficients for each frequency frame. Informal listening of the output signal with input from various acoustical conditions, such as cases with single and multiple talker and with or without background noise, revealed that the level of the artifacts is clearly lowered when using $\hat{G}$ instead of G. An additional rule can be defined, which was found to further suppress these remaining artifacts. A minimum value A may be introduced for the $\hat{G}$ function, which limits the minimum attenuation further, following the averaging process:

(according to Equation) (11)

where λ is a lower bound for the parameter $\hat{G}$. The minimum value of the derived parameter $\hat{G}^+$ using the method according to the invention or its algorithm can be adjusted according to the application being a compensation between the effectiveness of the spatial filtering method and the preservation of the quality of the unprocessed signal. By modifying (9) accordingly, the output $\hat{S}$ is:

$$\hat{S}(k,i)=\hat{G}^+(k,i)M_0(k,i), \quad (12)$$

in which an inverse Short Time Fourier Transform (iSTFT) could be applied to obtain the time domain signal $\hat{S}(n)$. The signal $M_0(k, i)$ being attenuated by the time-frequency factors contained in $\hat{G}^+(k, i)$, should originate from a microphone pattern with low order, not suffering from amplified low frequency noise. The attenuation parameters of $\hat{G}^+(k, i)$ though are computed using higher-order microphone signals with time averaging. $M_0$ can originate from any kind of microphone as long as it satisfies (8). The low-frequency noise in higher-order signals potentially causes only some erroneous analysis results in the computation of the parameters, however, the temporal averaging mitigates the noise effects. The low-frequency noise in $M_1$ and $M_2$ is not audible in the resulting audio signal S^(n) as noise, since the higher-order signals are not used as audio signals in reproduction.

Optional. Multi-Resolution Short Time Fourier Transform (STFT) Implementation of Cross Pattern Coherence The use of multi resolution STFT in the proposed algorithm offers a great advantage as it increases temporal resolution. Each microphone signal is first divided into different frequency regions and the method/algorithm is applied to each different region separately. An inverse STFT is applied then to transform the signal back to time domain. Different window sizes in the initial STFT shift the resulting signals in time and thus a time alignment process is needed before the summation.

Further advantageous implementations of the invention can be taken from the description of the figures as well as the dependent claims.

LIST OF DRAWINGS

In the following, the invention is disclosed in more detail with reference to the exemplary embodiments illustrated in the accompanying drawings in FIGS. 1 to 10, of which:

Figure 9:
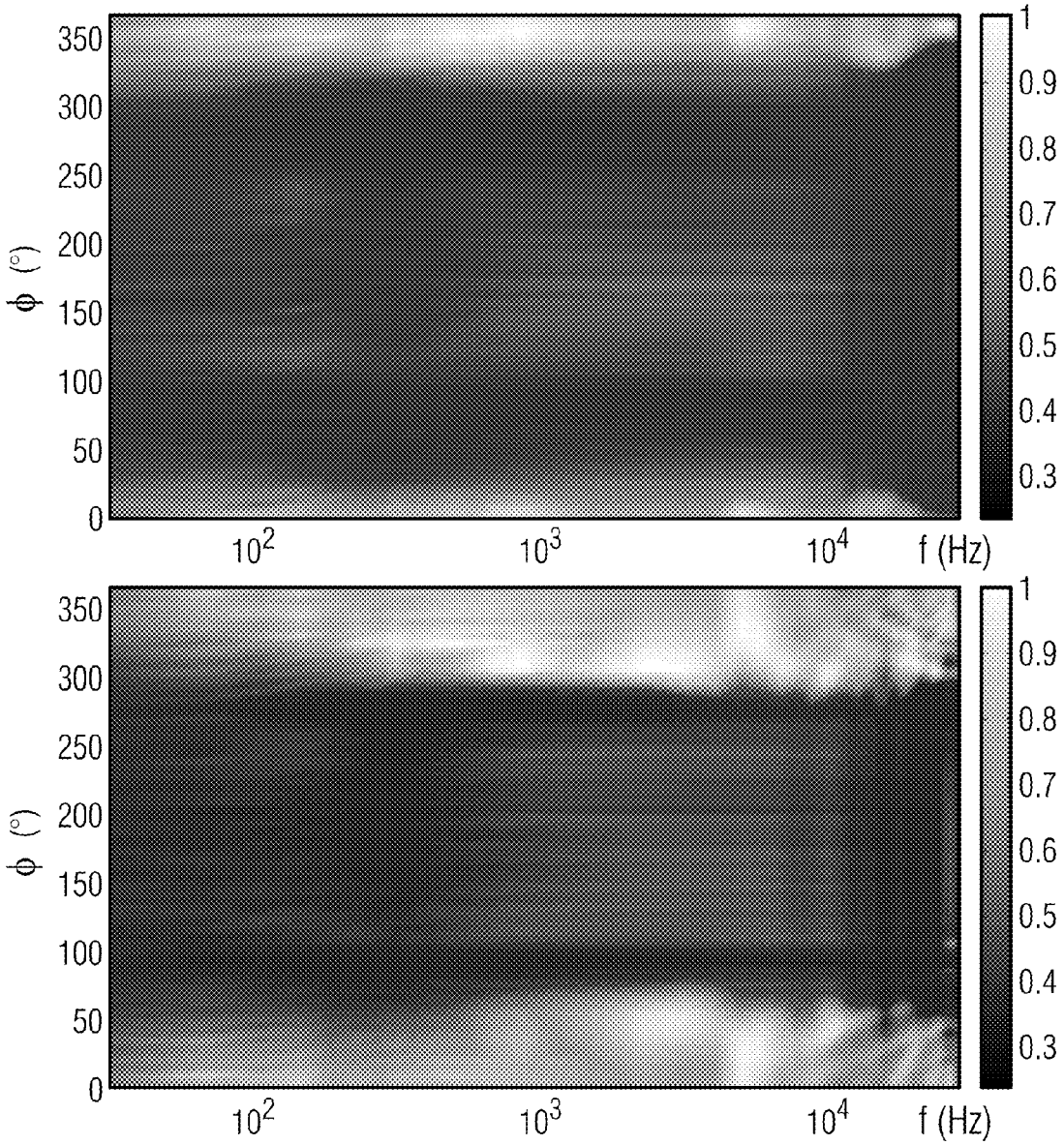
Figure 10:
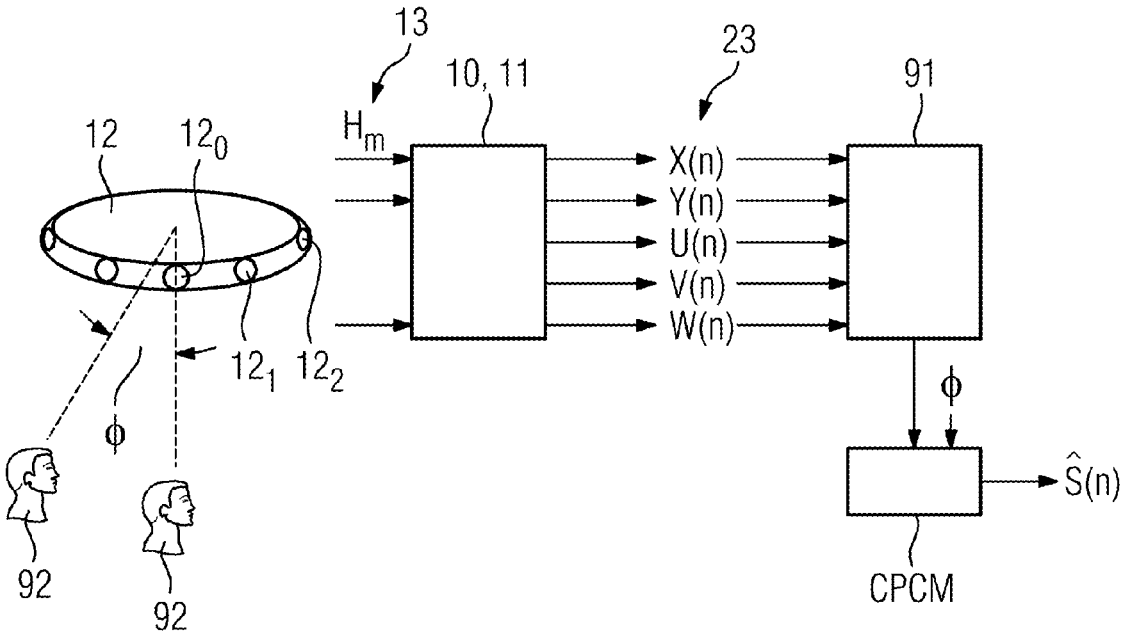

FIG. 9 illustrates the directivity pattern of the beamformer in the horizontal (top) and vertical (bottom) plane; and FIG. 10 illustrates a conference phone configured to the use of an integrated microphone array to record various talkers, each one of them at relative angle □. The microphone outputs are preprocessed and stored in a database. Then data is processed with the CPCM module and the desired angle □ either to listen to a single talker or separate some or all of them from the mixture.

Same reference symbols refer to same features in all FIG

DETAILED DESCRIPTION OF THE FIGURES

In the following the method is demonstrated with some embodiments in various scenarios, where the input consists of microphone signals with three different arbitrary orders, for example of zeroth, first and second-order signals. More and/or other orders of the signal may be employed. The method measures the correlation/coherence between two of the captured sound signals having the positive-phase maximum in directivity response towards the desired direction in each time-frequency position. A time-dependent attenuation factor is computed for each time-frequency position based on the time-averaged coherence between two captured sound signals. The corresponding time-frequency positions in the third captured signal are then attenuated at the positions where low coherence is found. In other words, the application of the method according to the invention is feasible with any order of directivity patterns available, and the directivity of the beam can be altered by changing the formation of the directivity patterns of the signals from where the correlation/coherence is computed.

Figure 1:
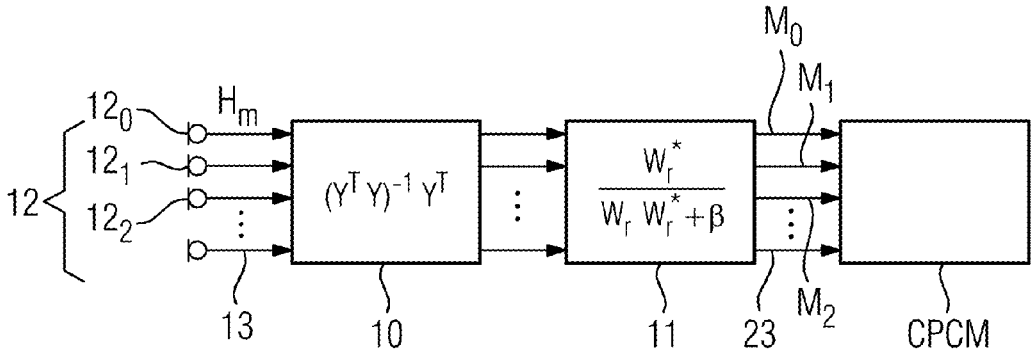
FIG. 1 illustrates the encoding process of obtaining the microphone signals from a microphone array.

FIG. 1 illustrates the encoding process of obtaining the microphone $\mathbf{12}_0$, $\mathbf{12}_1$, $\mathbf{12}_2$, . . . signals from a microphone 12 array, where a number of pressure microphones are on a spherical (3D) or circular (2D) arrangement or cylindrical (2D) arrays or by other suitable arrays, wherein the spherical or cylindrical harmonic functions are used as gain functions and the microphone signals 23 are processed with the proposed Cross Pattern Coherence (CPC) algorithm, for instance, in a CPC module.

Even though matrixing 10 and equalization unit 11 are advantageously carried out as here proposed and in FIG. 1 illustrated, we can use instead of the spherical or cylindrical harmonic functions also any suitable functional computational method.

The sound signal 13 inputs of different order stem from the respective microphones 12 which may be of any order, in particular higher orders. These are put into the proper matrixing 10 for consecutively being treated in the equalization unit 11. After the equalization they are ready to be fed into the CPC module CPCM.

Numerical Simulations using an Ideal Array

1) Implementation of a Cross Pattern Coherence (CPC) algorithm according to the spatial filtering method is now derived for a typical case, where the signals of zeroth ($W_{ns}$), first ($X_{ns}$ and $Y_{ns}$) and second order ($U_{ns}$ and $V_{ns}$) signals are available. The subscript ns indicates that the signals are calculated for the numerical simulation. The flow diagram of the method in this case is according to FIG. 2.

The CPC module (CPCM) employs five microphone stream 23 inputs to feed the captured signals 23 into the CPC module to immediately have them Fourier transformed by the Short Time Fourier Transformation (STFT) units. Optional energy unit 24 computes the energy based on the higher order captured microphone signals to feed the result to the normalization unit 27. Two streams of higher order signals are processed in the correlation unit 26. The correlation is then passed through the normalization unit 27, which leads to the gain parameter G(k,i).

The optional but very effective time averaging step is carried out in the time averaging unit 28. The "half-wave" rectification is carried out in the following recitifier 29. After that the gain parameter is given to the synthesis module 22 to apply the gain parameter onto separate microphone stream 23 for imposing the spatial noise suppression. It is to be noted here that even though the number of microphone stream inputs 23 and stream arrays 20 is five in our example, it is clear that more or less of them can be used. However, a minimum of three is required.

The microphone patterns are derived on the simple basis of cosine and sinusoidal functions. For two sound sources $s_1(n)$ and $s_2(n)$ the $0^{th}$, $1^{st}$ and $2^{nd}$ order signals are defined as:

(according to Equation) (13)

where $\phi_1$ and $\phi_2$ indicate the azimuth directions of each separate source. In that way we are able to position sound sources in specific azimuthal locations around the ideal microphone signals. The noise components are indicated with $n_w(n)$, $n_x(n)$, $n_y(n)$, $n_u(n)$, $n_v(n)$ for each order. Filtered white gaussian zero mean processes with unit variance are added to each ideal microphone signal to simulate the internal microphone noise: a $0^{th}$ order low pass filter is applied to $n_w(n)$ to simulate the $0^{th}$ order microphone signal internal noise, a $1^{st}$ order low pass for $n_x(n)$, $n_y(n)$ and $2^{nd}$ order for $n_u(n)$, $n_v(n)$. The Signal-to-noise Ratio (SnR) between the test signals and $n_w(n)$ is 20 dB. The time-frequency representation of each microphone component ($W_{ns}$, $X_{ns}$, $U_{ns}$, $V_{ns}$) is then computed. By substituting $M^1{}_1=X_{ns}$, $M^1{}_2=U_{ns}$, $M^{-1}{}_1=Y_{ns}$ and $M^{-1}{}_2=V_{ns}$ in Eq (7) the spatial parameter $G_{ns}$ in the analysis part of the CPC algorithm is:

(according to Equation) (14)

Figure 2:
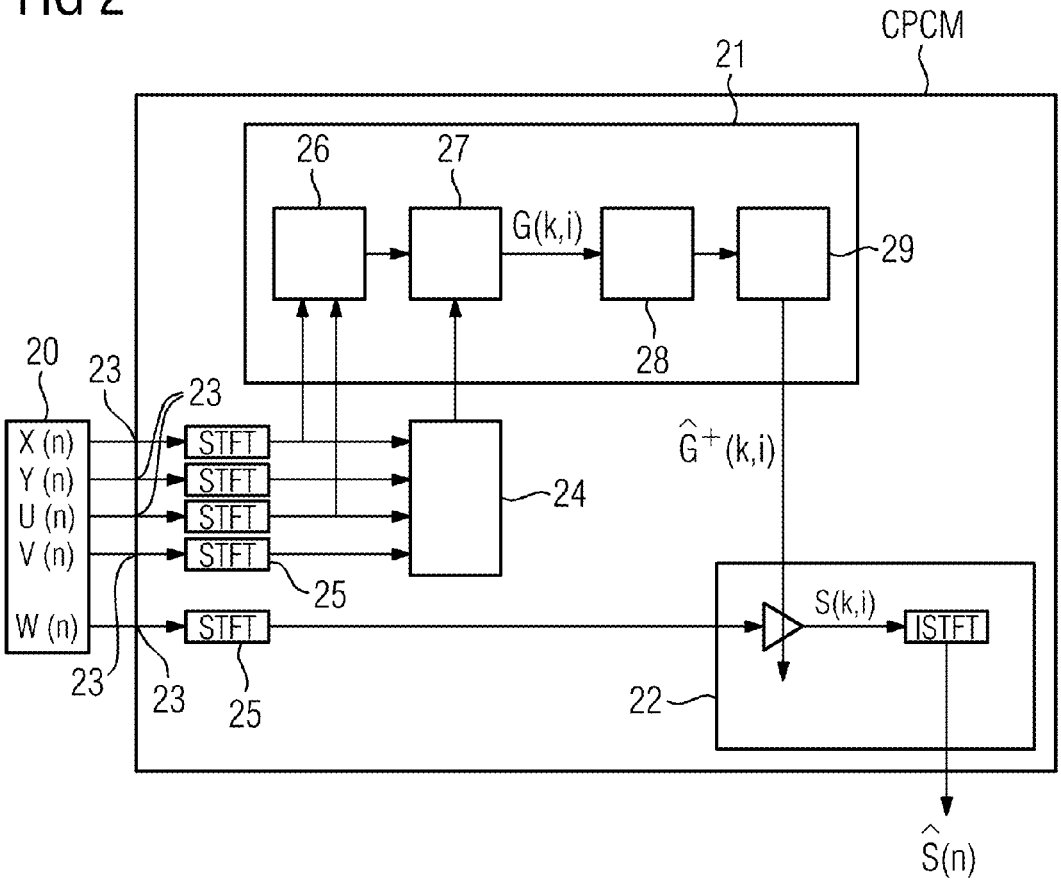
FIG. 2 illustrates a block diagram of the Cross Pattern Coherence (CPC) algorithm implemented with zeroth (W), first (X,Y), and second (U,V) order microphone signals.
Figure 3:
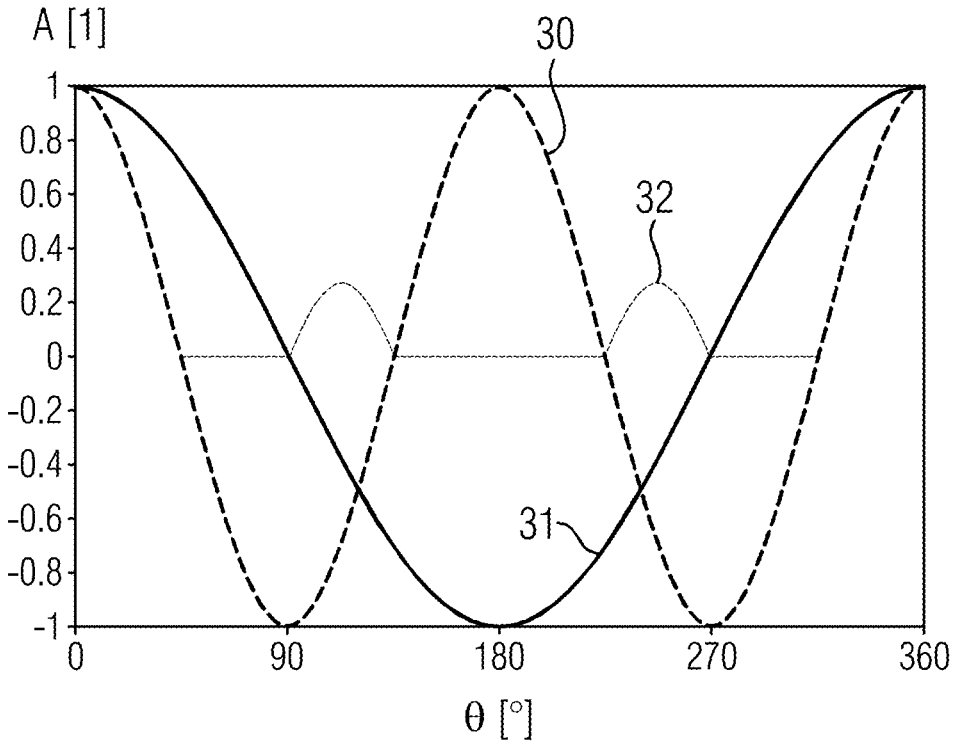
FIG. 3 illustrates ideal directivities for first (dipole) and second (quadruple) order microphones. The dotted line shows the half-wave rectified product of the two ideal components.

The process of CPC for this case is summarized in a block diagram in FIG. 2 for $M_0=W_{ns}$. The temporal averaging coefficient $\alpha$ is frequency depended and varies between 0.1 and 0.4. The lower values result to a higher average and are used for low frequencies. Higher values of 0.4, i.e. less average are used for the high frequencies. Proposed values for the frequency dependent averaging coefficient can be found in [18] for applause input signals and can be further optimized according to the input signals. Informal listening revealed that a value of $\lambda=0.2$ performs well for most cases, which is approximately the same as the maximum amplitude of the side lobes that are produced by the product of the first-order dipole and second-order quadrupole components shown in FIG. 3. The gain factor G is half wave rectified in order to obtain a unique beamformer look direction. Then the possible artifacts can be avoided since the correlation also would allow negative values, which could be troublesome during a signal synthesis, where the gain factor is applied to a microphone stream or a third captured signal imposing the directivityly dependent gain on the stream or the third captured signal, thereby attenuating input from directions with low coherence measure. In FIG. 3 the amplitude A of the gain factor G is plotted over the angle. The plot of the gain factor is labelled 32. The regions of positive values are due to the correlation limited to the intervals where both the first order 31 and second order 30 have a negative amplitude.

Figure 4:
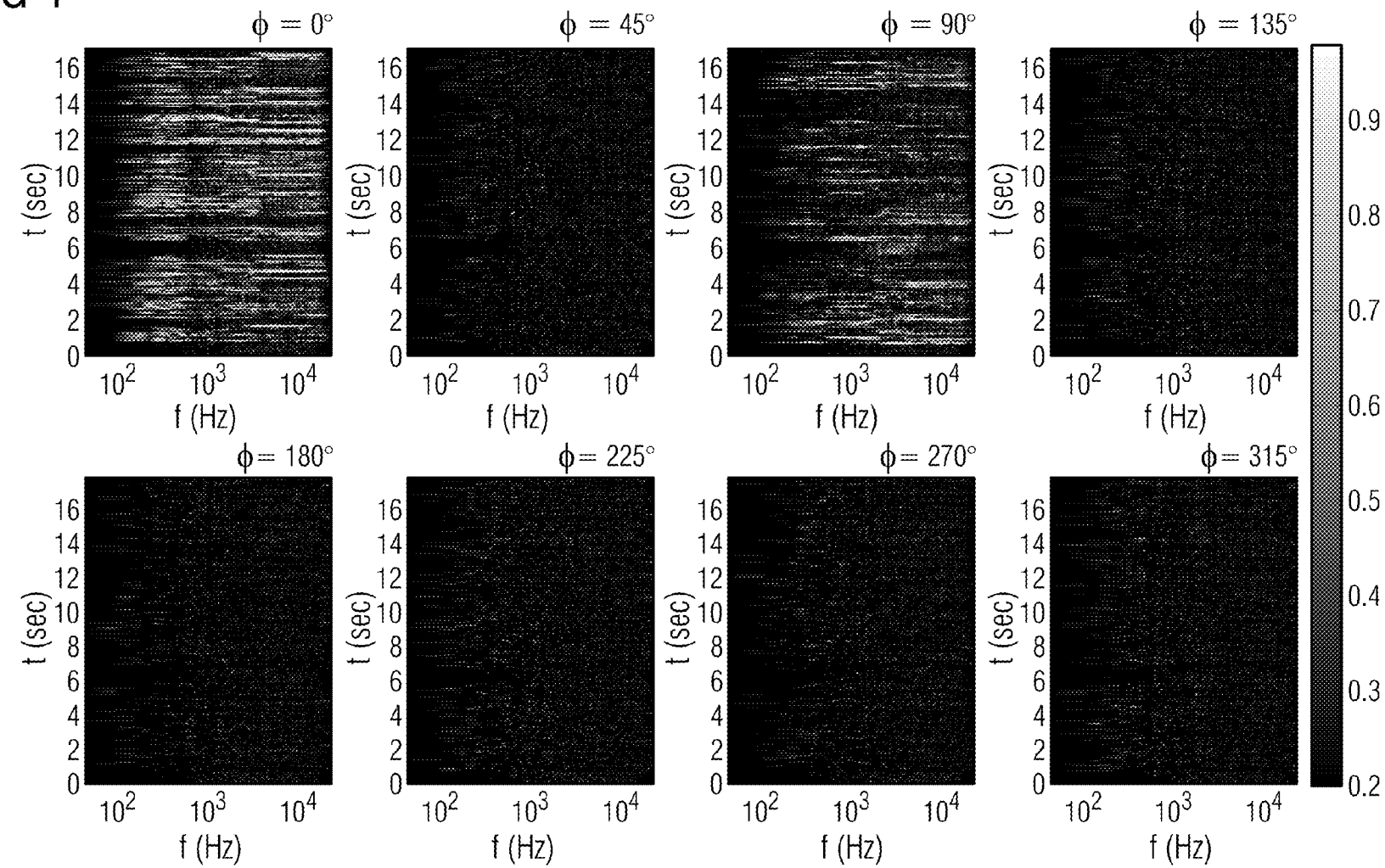
FIG. 4 illustrates a G^+ function for 8 different directions every 45° in a virtual multi-speaker scenario with two active speakers applying the CPC algorithm utilizing ideal microphone components.

In the multi-resolution STFT, three different frequency regions are used, the first with an upper cut-off frequency of 380 Hz, the second with a lower cutoff of 380 Hz and upper cutoff of 1500 Hz and the third one with a lower cutoff of 1500 Hz. The STFT window sizes of each frequency band were N=1024, 128 and 32 accordingly with a hop size of N/2. Two talker sources are virtually positioned at $\phi_1=0°$ and $\phi_2=90°$ in the azimuthal plane. The parameter $G_{ns}$ is then calculated for different beam directions starting at 0° and rotating every 45°. FIG. 4 shows the derived gain function for different angles. Signal activity is clear at exactly 0° and 90° where the sources are initially positioned. For the angles of 45°, 135°, 180°, 225°, 270° and 315 where there is no signal activity originally, interfering sources are attenuated.

Figure 5:
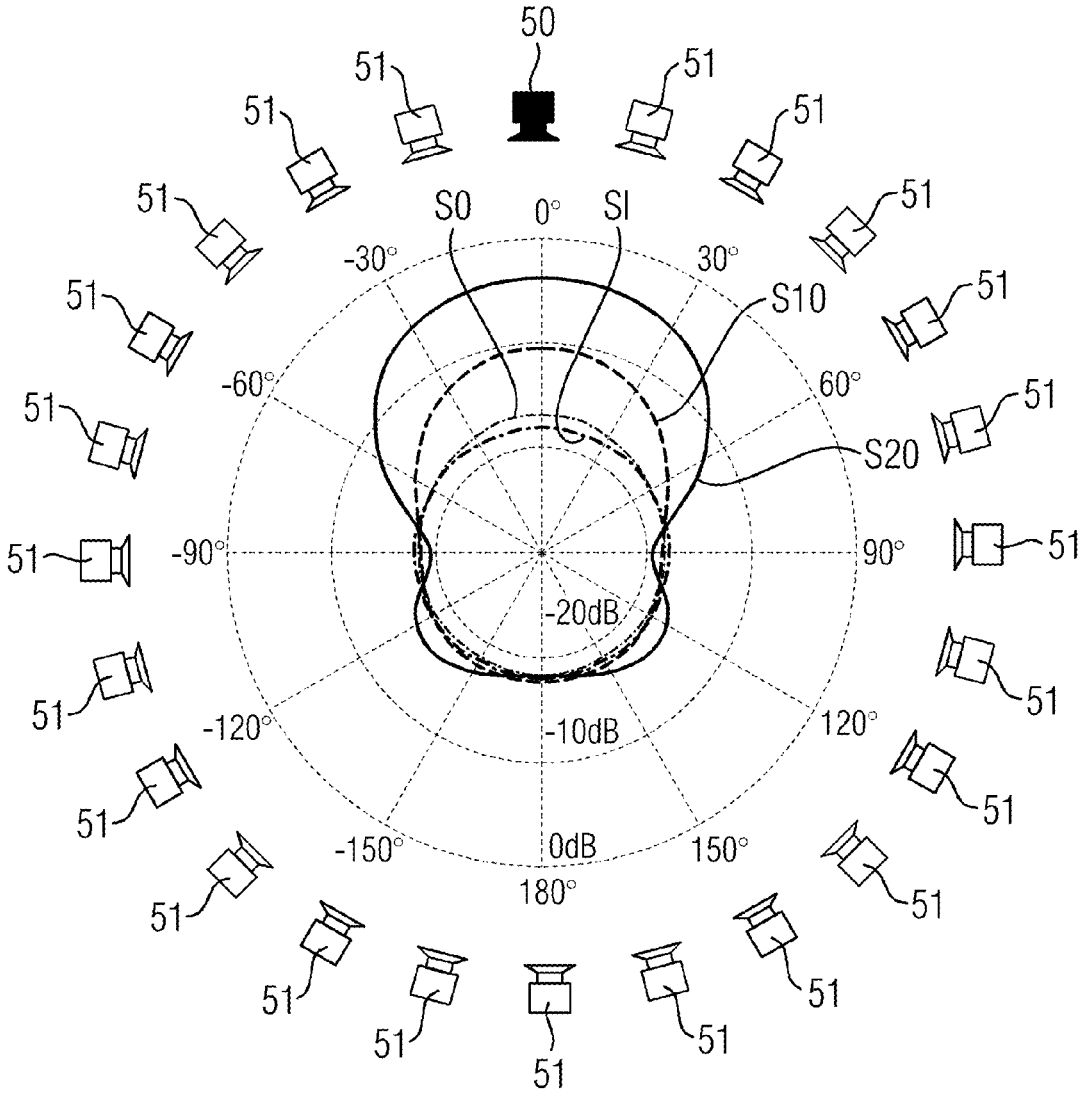
FIG. 5 illustrates directivity attenuation patterns G^+ of the CPC algorithm with a single source and diffuse noise in dB.
Figure 6:
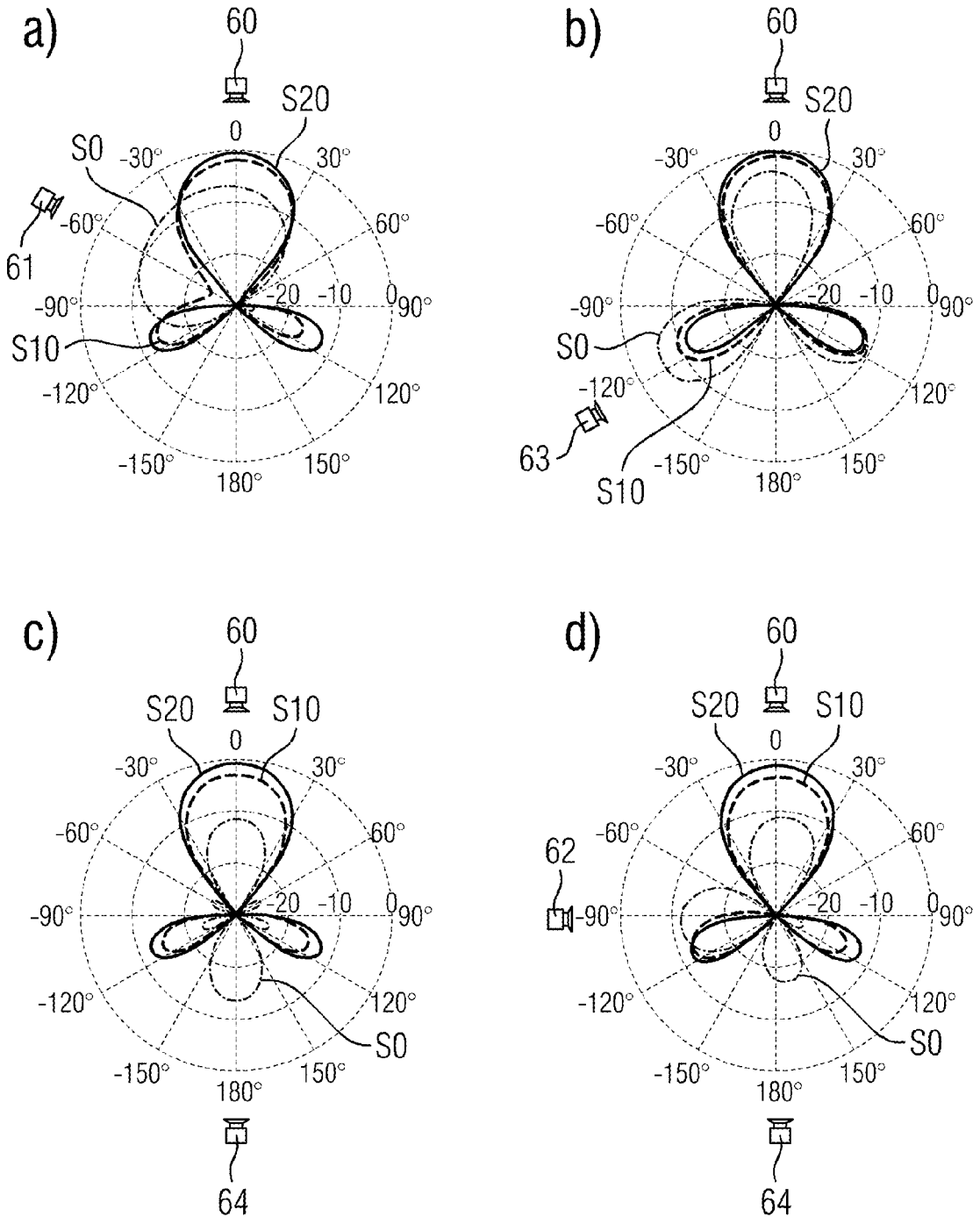
FIG. 6 illustrates the directivity attenuation patterns of G^+ of the CPC algorithm with (a) a single sound source at 0° and an interfering source at 60°, (b) a sound source at 0° and an interfering source at −120°, (c) a sound source at 0° and an interfering source at 180° and (d) and a sound source at 0° and two interfering sources at −90° and 180° in dB.

2) Directivity Attenuation Pattern of the Beamformer:

The functioning of the CPC algorithm is demonstrated by deriving the directivity attenuation patterns in different sound scenarios. A similar method for assessing the performance of a real-weighted beamformer has been used in [25] by employing the ratio of the power of the beamformer output in the steering direction over the power of the average power of the system. The directivity patterns in this case are derived by steering the beamformer every 5° and calculating the $G^{\hat{}+}$ value for each position, while maintaining the sound sources at their initial position. In this example a scenario with single and multiple sound sources has been simulated. Sound sources with and without background noise levels and different SnRs are positioned at various angles around the virtual microphone array. FIGS. 5 and 6 show the directivity patterns of the algorithm for the various cases.

In FIG. 5 The directivity/attenuation pattern is calculated, under different Signal to Noise Ratios (SnR) between the sound source and the sum of the noise sources for all beam directions. Grey loudspeakers 51 indicate sources for the diffuse noise, whereby the source 50 emits the acoustic signal.

The sound source 50 is positioned at 0°. The diffuse noise has been generated with 23 noise sources 51 positioned around the virtual microphone array equidistantly. The directivity pattern shows the performance of the beamformer under different SnR values between the single sound source and the sum of the noise sources. While the beam is steered towards the target source at 0° the attenuation is 4 dB with an SnR of 20 dB. The corresponding pattern S20 is the most asymmetric an most advantageous choice. As the beam is steered away form the target source there is a noticeable attenuation of up to 12 dB in the area of ±60°. Outside the area of ±60° the attenuation level varies between 15 to 19 dB. With an SnR of 10 dB the level that the beamformer applies to the target source is −10 dB and attenuates the output to 18 dB outside the area of ±30°, as it can be seen on the pattern S10. For lower SnR values of 0, pattern S0, and −inf, pattern SI, in diffuse field conditions the beamformer assigns a uniform attenuation of 18 dB for all directions. This part of the simulation thus suggests that in diffuse conditions the SnR has to be approximately 20 dB in a given time-frequency frame for CPC to be effective.

The directivity attenuation patterns in double sound source scenarios are illustrated in FIGS. 6 (*a*), (*b*) and (*c*). The main sound source 60 is positioned at 0° and the interferer is positioned at 60°, 120° and 180° for each case respectively, while the beam aims initially towards 0°. The patterns are calculated under different SnR between the main and interfering sources. In the first case in FIG. 6 (*a*) the beamformer provides an attenuation of 1 dB when it is steered towards the main sound source and an SnR of 20 dB (curve S20). A lower attenuation of 2 dB is provided when the SnR drops to 10 dB (curve S10). The attenuation decreases outside the region of ±20° up to 20 dB for SnR=20 dB and 14 dB for SnR=10 dB. In the areas between [−100°, −130° ] and [100°, 130° ] the attenuation level is higher, approximately 12 dB for SnR=20 dB and 14 dB for SnR=20 dB. That is due to the microphone components that are chosen for the cross-pattern coherence calculation; first and second order generate an area of higher sensitivity between [−100°, −130° ] and [100°, 130° ]. While the level of the two sound sources is equal, in the case of SnR=0 dB (curve S0), a higher attenuation of 8 dB is provided for beam directions near 0° where the main sound source is and 10 dB when the beam is steered towards the interferer. The second case FIG. 6 (*b*) is specifically chosen to demonstrate the effect of the interfering sound source at −120° which is inside the high sensitivity area of the beamformer due to the choice of the microphone patterns. While the SnR is 20 dB and 10 dB the level difference for beam positions at 0° and −120° varies between 11 and 12 dB respectively. For all other positions outside the regions of ±20°, [−100, −130° ] and [110°, 130° ] the attenuation level is higher than 20 dB. When the SnR is 0 dB the attenuation levels differ 2 dB for beam positions at 0° and 120°. Similar results are obtained when the interfering sound source is positioned at 180°: the level of attenuation for the main sound source is 1 dB and 4 dB for beam position at 0°. For an SnR of 0 dB the level difference between the two different beam positions at 0° and 180° degrees is 3 dB.

In a multiple talker scenario in FIG. 6 (*d*), three sound sources 60,61,62,63,64 are present at the same time with the target source at 0° and two interferers at 90° and 180°. Again here the level provided by the beamformer is approximately the same, as in the two sound source scenario, for all beam directions for the cases of 20 dB (S20) and 10 dB SnR (S10). As expected from the previous cases (a), (b) and (c), when all sources receive the same level, the attenuation level that the beamformer applies is much lower, 10 dB for 0°, 11 dB for −90° and 18 dB for 180°.

It is thus evident that in the case of one or two interfering sources the performance of CPC is consistent and provides stable filtering results, not only for the cases of high SnR (20 and 10 dB), but also for some cases where the SnR is 0 dB. The advantages that are shown through this simulation are that the algorithm provides a high response when the direction of the beamformer coincides with the direction of a sound source. This is evident through the calculation of $G^{\hat{}+}$ for the diffuse field case with positive SnR values. For the cases of 20 and 10 dB SnR in a single or multi sound source scenario, the $G^{\hat{}+}$ values towards the direction of the main sound source differ to the original level by 1-2 dB. It is also evident that in all cases there is no high response towards any direction where there is no sound source, even in the case of diffuse noise only.

If we consider speech signals as sound sources, due to the sparsity and the varying nature of speech, the spectrum of the two speech signals when added can be approximated by the maximum of the two individual spectra at each time-frequency frame. It is then unlikely that two speech signals carry significant energy in the same time-frequency frame [26]. Hence, when the coherence between the microphone patterns is calculated, in the analysis part of the CPC, the $G^{\hat{}+}$ values will be well calculated for the steered direction which motivates the use of the CPC algorithm in teleconferencing applications. In other words, for simultaneous talkers the resulted directivity of the CPC algorithm can be assumed that falls into the case (a) in FIG. 6.

Measurements Using a Real Microphone Array

1) CPC Implementation:

The performance of the CPC algorithm is also tested with a real microphone array. An eight-microphone, rigid body, cylindrical array of 1.3 cm radius and 16 cm height is employed with equidistant sensor in the horizontal plane every 45°. The microphones are mounted on the half-height of the rigid cylinder perimetrically. The more sensors we have, the more we can increase the aliasing frequency, if compared to the same radius array with fewer sensors.

FIG. 6: The directivity attenuation is calculated, under different Signal to Noise Ratios (SnR) between the sound source and the interfering sources, for all beam directions with static sources.

The encoding equations to derive the microphone components for the specific array up to second-order, following (4) and the equalization process of (5), using the cylindrical harmonic framework, are:

(according to Equation) (15)

where $W_{re}(k, i)$, $X_{re}(k, i)$, $Y_{re}(k, i)$, $U_{re}(k, i)$ and $V_{re}(k, i)$ are the equalized microphone components. In contrary to the numerical simulation the equalization process when using a real array is more demanding as we are not employing ideal microphones and the directivity patterns of the microphone components vary along the frequency.

All other parameters such as the minimum value of attenuation $\lambda$, the temporal averaging $\alpha$ and the frequency regions for the multi-resolution STFT are set previously.

Figure 7:
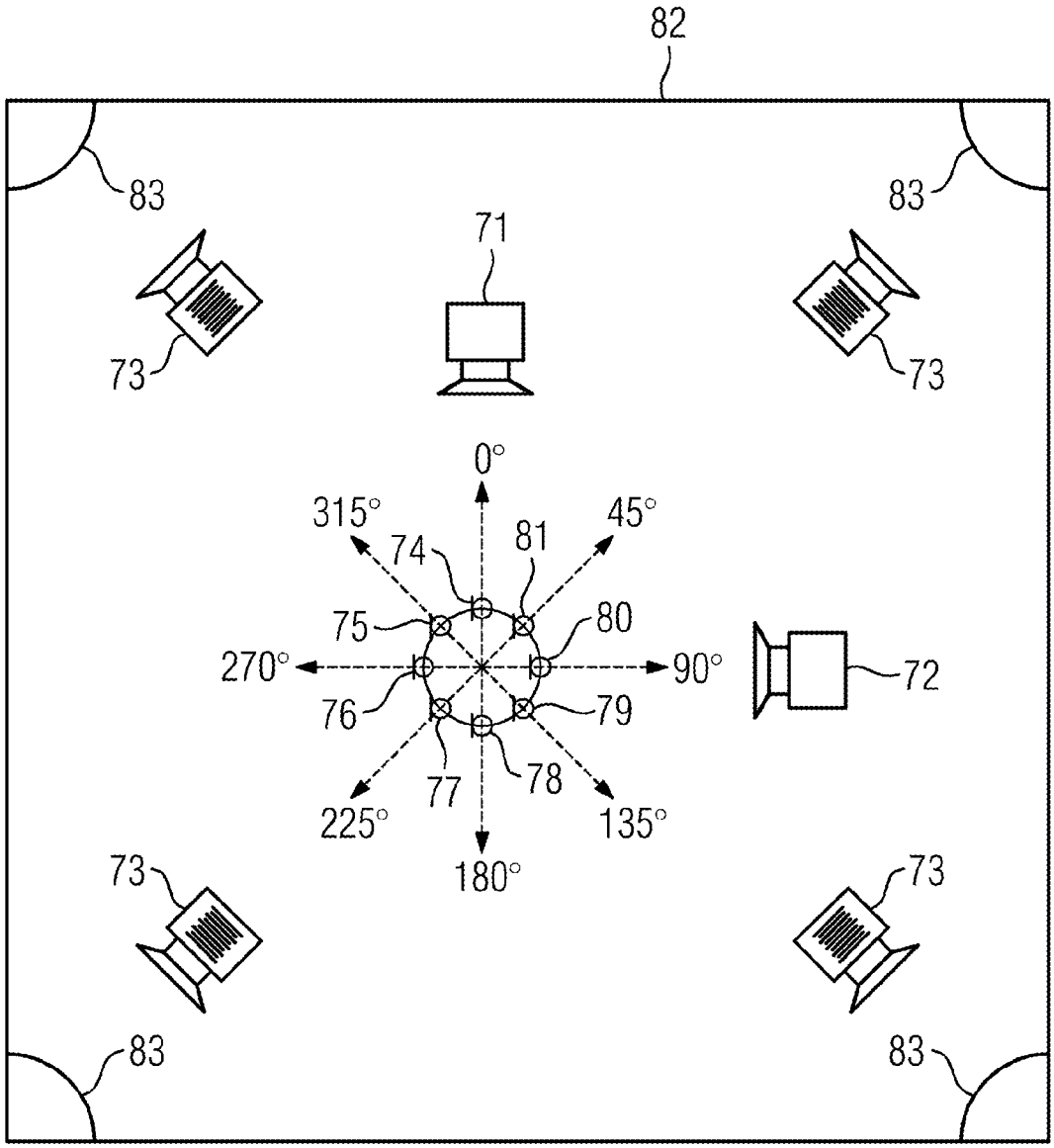
FIG. 7 illustrates an arrangement of the measurement system, where the microphone array steers a full circle in 8 directions every 45° detecting sound from each direction.

As shown in FIG. 7, the array is placed in the center of a listening room mounted on top of a tripod and a sound field is created. The sound field is generated with two loudspeaker 71, 72 placed at 0° and 90°, respectively, in the azimuthal plane 1.5 m away from the microphone array transmitting speech signals simultaneously. Background noise is created with four additional loudspeakers 73 placed at the corners of the room and facing towards diffusers 83.

Figure 8:
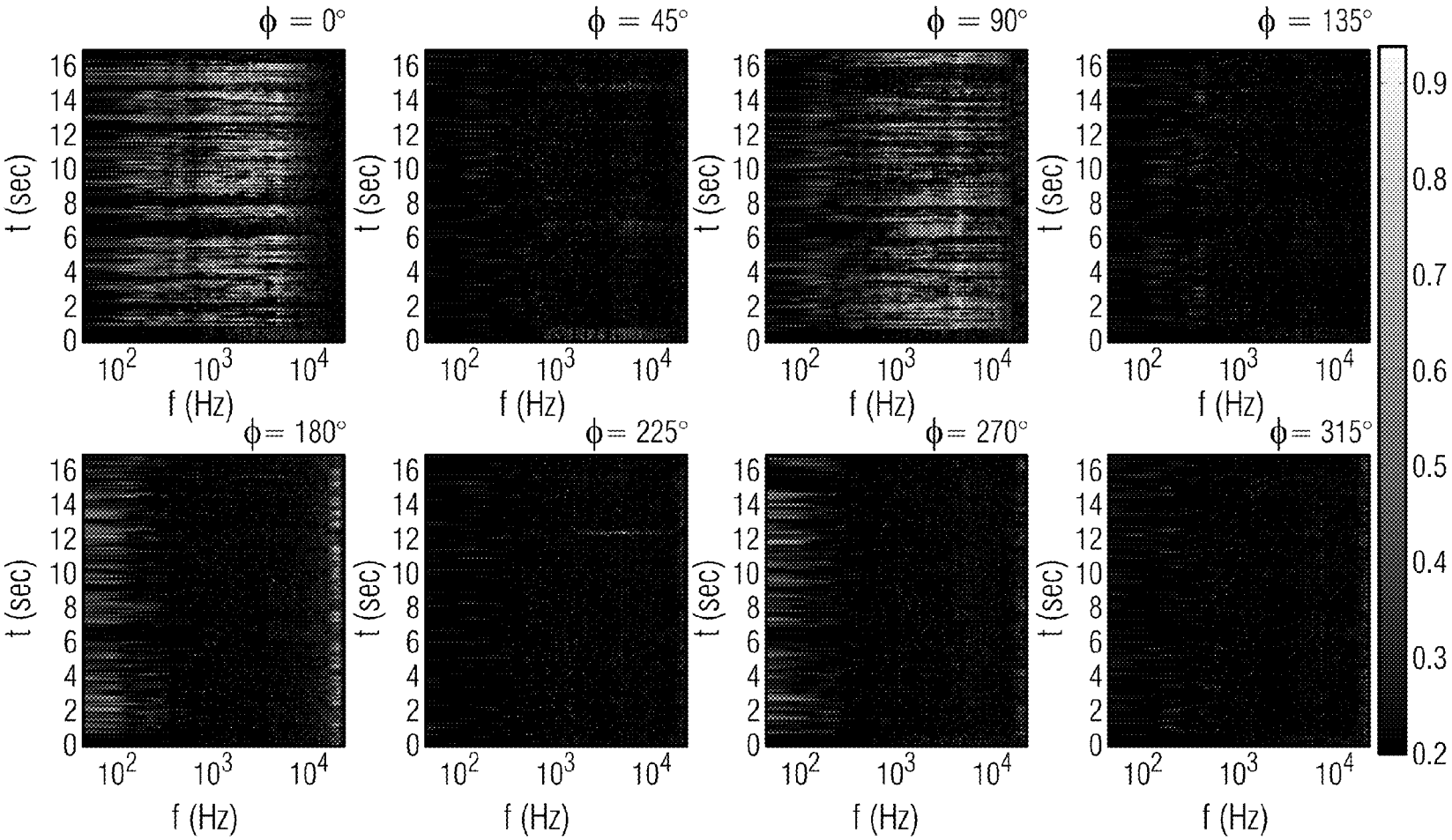
FIG. 8 illustrates the G^+ function for 8 different directions every 45° in a real life multi speaker scenario with two active speakers and background noise applying the CPC algorithm in an eight channel microphone array.

An example case of the performance of the CPC algorithm in a multi speaker scenario is shown in FIG. 8. Eight different $G^{\hat{}+}$ values are calculated for each different beam direction (0°, 45°, 90°, 135°, 180°, 225°, 270° and 315°). The CPC algorithm is assigning attenuation factors to each direction according to whether there is signal activity at that specific angle. This signal activity is indicated correctly at 0° and 90°. We can obtain a small enough even though slightly noticeable spectral coloration in the $G^{\hat{}+}$ coefficient. This result supports the simulation results shown in FIG. 4.

2) Directivity Pattern Measurements:

Directivity measurements are performed in an anechoic environment to show the performance of the CPC algorithm utilizing the cylindrical microphone array. White noise is used as a stimulus signal of two seconds duration. The stimulus is fed to a single loudspeaker and the array is placed 1.5 meters away from the loudspeaker. The microphone array is mounted on a turntable able to perform consecutive rotations of 5 degrees and one measurement is performed for each angle.

Each set of measurements is transformed into the STFT domain and the spatial parameter $G^{\hat{}+}$ values are calculated for each rotation angle with static sources. In that way a directivity plot of the specific microphone array is obtained in this sound setting. FIG. 9 shows the performance in the horizontal and vertical plane.

A stable performance is obtained in the horizontal plane where the $G^{\hat{}+}$ function is constant in the frequency range between 50 Hz to 10 kHz which is approximately the spatial aliasing frequency. The beamformer receives a constant $G^{\hat{}+}$ value in the horizontal plane in the look direction of 0° with an angle span of approximately ±20°. In the vertical plane the method is capable of delivering valid $G^{\hat{}+}$ values for elevated sources that are not on the same plane as the microphone of the array. The maximum angle span where the beamformer provides high $G^{\hat{}+}$ values in that case is ±50° in elevation. In that case a noticeable spectral coloration is shown for directions that are between [20°, 50° ] and [300°, 340° ] due to the frequency dependent $G^{\hat{}+}$ values.

In summary, the Cross Pattern Coherence (CPC) Method is a parametric beamforming technique utilizing microphone components of different order, which have otherwise different directivity patterns. However, response is equal towards the direction of the beam. A normalized correlation value between two signals is computed in time frequency domain, which is used to derive a gain/attenuation function for each time frequency position. A third audio signal, measured in the same spatial location, is then attenuated or amplified using these factors in corresponding time-frequency positions. Practical implementation in both the numerical simulation and the real array incite that the method is resilient to few sound sources and becomes less resilient with diffuse noise and low SnR values.

FIG. 10 illustrates an apparatus that is a conference phone comprising a number of microphones 12 that can be of any order, in particular of higher orders. Three microphones $\mathbf{12}_0$, $\mathbf{12}_1$, $\mathbf{12}_2$ have been denoted in FIG. 10. The apparatus is configured to the integrated microphone array to record various talkers 92, each one of them at a relative angle □. Some or all microphone 12 outputs $H_m$ are preprocessed (through matrixing 10 and equalization unit 11) and stored in a database 91 as microphone streams 23. Stored microphone streams 23 are processed with the CPCM module and the desired angle □ either to listen to a single talker 92 or separate some or all of the talkers 92 from the mixture contained in the microphone streams 23.

In other words, the spatial filtering system is comprised in the teleconference apparatus comprising an array of microphones, or connected to the teleconference apparatus, and configured to apply the gain factor $G^{\hat{}+}$ to the corresponding time-frequency positions in the third captured sound signal $M_0$ or W(n) in the microphone streams 23 real-time during a meeting or teleconference.

The system or the apparatus may comprise a database 91 or another data repository and be configured or configurable to apply the gain factor $G^{\hat{}+}$ to the corresponding time-frequency positions in the third captured sound signal $M_0$ or W(n) that have been stored in the database 91 or in the other data repository.

The system may further comprise a means for manually or automatically entering or selecting the desired look direction □. By selecting the desired look direction □ it is at least in principle possible to differentiate between a number of simultaneous talkers that are seated around a conference table. The differentiation (i.e. separation of each talker's voice, a particular talker's voice or of some talkers' voice) may be carried in real-time or afterwards.

In other words, the parametric method for spatial filtering of at least one first sound signal includes the following steps:

- Generation of a first captured sound signal by capturing of the at least one sound signal by a first microphone, whereby the first microphone is characterized by a first directivity pattern,
- Generation of a second captured sound signal by capturing of the at least one sound signal by a second microphone, whereby the second microphone is characterized by a second directivity pattern,
- The first and second microphone constitute one real microphone or one microphone array, characterized by a multiple of directivity patterns of different orders, whereby the first directivity pattern as well as the second directivity pattern constitute respectively one particular directivity pattern of said multiple of directivity patterns of different orders,
- Calculation of a gain factor (G) for a look direction using a cross-pattern correlation between the first captured sound signal and the second captured sound signal, both captured sound signals with directivity pattern of the same look direction.

In still other words, the spatial filtering system based on cross-pattern correlation or cross-pattern coherence comprising acoustic streaming inputs for a microphone array with at least a first microphone and a second microphone and an analysis module performing the steps:

- Generation of a first captured sound signal by capturing of the at least one sound signal by the first microphone, whereby the first microphone is characterized by a first directivity pattern,
- Generation of a second captured sound signal by capturing of the at least one sound signal by the second microphone, whereby the second microphone is characterized by a second directivity pattern,
- The first and second microphone constitute one microphone array, characterized by a multiple of directivity patterns of different orders, whereby the first directivity pattern as well as the second directivity pattern constitute respectively one particular directivity pattern of said multiple of directivity patterns of different orders,
- Calculation of a gain factor for a look direction using a cross-pattern correlation between the first captured sound signal and the second captured sound signal, both captured sound signals with directivity patterns of the same look direction.

The invention is not to be understood to be limited in the attached patent claims but must be understood to encompass all their legal equivalents.

REFERENCE SYMBOLS

A amplitude
CPCM Cross Pattern Coherence Analysis Module
SI' graph based on an SnR=−∞ (negative infinity)
STFT Short Time Fourier Transformation
S0 graph based on an SnR=0 dB
S10 graph based on an SnR=10 dB
S20 graph based on an SnR=20 dB
$H_m$ microphone output
10 matrixing
11 equalization unit
12 microphones (e.g. $\mathbf{12}_1$, $\mathbf{12}_2$, $\mathbf{12}_0$) of any order, in particular of higher orders
13 microphone streams
20 stream array
21 analysis module
22 synthesis module
23 microphone streams
24 energy unit
25 Short Time Fourier Transformation
26 correlation unit
27 normalization unit
28 time averaging unit
29 rectifier
30 second order
31 first order
32 half-wave rectified product
50 loudspeaker emitting sound signal
51 loudspeaker emitting background noise
60 loudspeaker at 0°
61 loudspeaker at −60°
62 loudspeaker at −90°
63 loudspeaker at −120°
64 loudspeaker at 180°
71 loudspeaker at 0°
72 loudspeaker at 90°
73 loudspeaker to generate background noise
74 array microphone in direction 0°
75 array microphone in direction 315°
76 array microphone in direction 270°

77 array microphone in direction 225°
78 array microphone in direction 180°
79 array microphone in direction 135°
80 array microphone in direction 90°
81 array microphone in direction 45°
82 multi-speaker setup
83 diffusor
91 database
92 talker

REFERENCES

The following references are being used in the description of the prior art of the technical field as well as for the characterization of the mathematical modelling of the invention:

[1] Earl G. Williams, "Fourier Acoustics: Sound Radiation and Nearfield Acoustical Holography", Academic Press, Jun. 30, 1999.

[2] A. Ben-Israel and Thomas N. E. Greville, "Generalized Inverses: Theory and Applications", Springer, Jun. 16, 2003.

[3] H. Teutsch, "Modal Array Signal Processing: Principles and Applications of Acoustic Wavefield Decomposition", Berlin Heidelberg: Springer-Verlag, 2007.

[4] B. Rafaely, "Analysis and Design of Spherical Microphone Arrays", IEEE Trans Audio, Speech and Language Processing, Vol. 13, No. 1, pp 135-143, January 2005.

[5] M. Brandstein and D. Ward, "Microphone Arrays", New York: Springer, 2001.

[6] S. L. Gay and J. Benesty, "Acoustic Signal Processing of Telecommunications", Eds. Kluwer Academic Publishers, 2000.

[7] S. Moreau, J. Daniel, S. Bertet, "3D Sound Field Recording with Higher Order Ambisonics—Objective Measurements and Validation of Spherical Microphone", presented at the AES 120th Convention, Paris, France, 2006, May 20-23.

[8] O. Kirkeby, P. A. Nelson, H. Hamada, F. Orduna-Bustamante, "Fast Deconvolution of Multichannel Systems Using Regularization", IEEE Trans Audio, Speech and Language Processing, Vol. 6, No. 2, pp. 189-195, March 1998.

[9] O. Kirkeby, P. A. Nelson, "Digital Filter Design for Inversion Problems in Sound Reproduction", J. Audio Eng. Soc., Vol. 47, no. 7/8 (1999 July/August).

[10] J. Daniel, R. Nicol, and S. Moreau, "Further investigations of High Order Ambisonics and Wavefield Synthesis for holophonic sound imaging", Proc. of the 114th Convention of the Audio Engineering Society, Amsterdam, Netherlands, Mar. 22-23, 2003.

[11] V. Pulkki, "Spatial Sound Reproduction with Directivity Audio Coding", J. Audio Eng. Soc., Vol 55, pp. 503-516, 2007 June.

[12] M. Kallinger, H. Ochsenfeld, G. Del Caldo, F. Kuech, D. Mahne, R. Schultz-Amling, O. Thiergart, "A Spatial Filtering Technique for Directivity Audio Coding", presented at the AES 126th Convention, Munich, Germany, 2009 May 7-10.

[13] Kallinger, M.; Del Galdo, G.; Kuech, F.; Mahne, D.; Schultz-Amling, R.; "Spatial filtering using directivity audio coding parameters," Acoustics, Speech and Signal Processing, 2009. ICASSP 2009. IEEE International Conference on, vol., no., pp. 217-220, 19-24 Apr. 2009

[14] R. Schultz-Amling, F. Kuech, M. Kallinger, G. Del Galdo, J. Ahonen, V. Pulkki, "Planar Microphone Array Processing for the Analysis and Reproduction of Spatial Audio using Directivity Audio Coding", presented at the AES 124th Convention, Amsterdam, The Netherlands, 2008 May 17-20.

[15] C. Faller, "A Highly Directive 2-Capsule Based Microphone System", presented at the AES 123rd Convention, New York, N.Y., USA, 2007 Oct. 5-8.

[16] C. Faller, "Obtaining a Highly Directive Center Channel from Coincident Stereo Microphone Signals", presented at the AES 124th Convention, Amsterdam, The Netherlands, 2008 May 17-20.

[17] C. Faller, "Modifying the Directivity Responses of a Coincident Pair of Microphones by Postprocessing", J. Audio Eng. Soc., Vol 56, pp. 810-822, 2008 October.

[18] M. V. Laitinen F. Kuech, S. Disch, V. Pulkki, "Reproducing Applause-Type Signals with Directivity Audio Coding", J. Audio Eng. Soc., Vol 59, No 2, 2011 June.

[19] C. Faller, "Modifying the Directivity Response of a Coincident Pair of Microphones by Postprocessing", J. Audio Eng. Soc., Vol 56, No. 10, 2008 October.

[20] Y. Hur, J. S. Abel, Y-C Park, D. H Youn "Techniques for Synthetic Reconfiguration of Microphone Arrays", J. Audio Eng. Soc., Vol 59, No. 6, 2011 October.

[21] H. Teutsch and W. Kellermann, "Acoustic source detection and localization based on wave field decomposition using circular microphone arrays", J. Audio Eng. Soc., Vol 120, No. 5, 2006 November.

[22] Manders, A. J.; Simpson, D. M.; Bell, S. L.; "Objective Prediction of the Sound Quality of Music Processed by an Adaptive Feedback Canceller," Audio, Speech, and Language Processing, IEEE Transactions on, vol. 20, no. 6, pp. 1734-1745, August 2012

[23] D. J. Freed and S. D. Soli, An objective procedure for evaluation of adaptive antifeedback algorithms in hearing aids, Ear Hear., vol. 27, no. 4, pp. 382398, 2006.

[25] Tourbabin, V.; Agmon, M.; Rafaely, B.; Tabrikian, J.; "Optimal Real-Weighted Beamforming With Application to Linear and Spherical Arrays", Audio, Speech, and Language Processing, IEEE Transactions on, vol. 20, no. 9, pp. 2575-2585, November 2012

[26] S. Roweis. "Factorial models and refiltering for speech separation and diagnoising". In Proc. Eurospeech, September 2003.

[27] S. Delikaris-Manias; V. Pulkki, "Cross Pattern Coherence Algorithm for Spatial Filtering Applications Utilizing Microphone Arrays", IEEE Trans Audio, Speech and Language Processing, Vol. 21, No. 11, pp. 2356-2367, November 2013.

$$A_{pq}^{\sigma}(n) = H_m(n)\{[Y_{pq}^{\sigma}(\phi,\theta)]^T Y_{pq}^{\sigma}(\phi,\theta)\}^{-1}[Y_{pq}^{\sigma}(\phi,\theta)]^T \tag{1}$$

$$Y_{pq}^{\sigma}(\phi,\theta) = \sqrt{\frac{2q+1}{4\pi}\frac{(q-p)!}{(q+p)!}}\,P_{qp}(\cos(\theta))R_q(\phi) \tag{2}$$

$$R_q(\phi) = \begin{cases} \sin(q\phi), & \text{if } \sigma = +1 \\ \cos(q\phi), & \text{if } \sigma = -1 \end{cases} \tag{3}$$

$$B_{pq}^{\sigma}(k,i) = A_{pq}^{\sigma}(k,i) * EQ_{pq}^{\sigma}(k,i) \tag{4}$$

$$EQ_{pq}^{\sigma}(k,i) = \frac{W_r^*(k,i)}{W_r^*(k,i)W_r(k,i)+\beta(k)} \tag{5}$$

$$\Gamma(k,i) = (M_1^1(k,i)^*)^T M_2^1(k,i) \tag{6}$$

$$G(k,i) = \frac{2 * \Re\,[\Gamma(k,i)]}{\sum_{\sigma=}^{1,-1} |M_1^{\sigma}(k,i)^2| + \sum_{\sigma=}^{1,-1} |M_2^{\sigma}(k,i)^2|} \tag{7}$$

-continued $$\sum_{\sigma=}^{1,-1} M_n^{\sigma}(\psi)^2 = M_0(\psi)^2 \tag{8}$$

$$S(k, i) = \max(0, G(k, i))M_0(k, i) \tag{9}$$

$$\hat{G}(k, i) = \alpha(k)\max(0, G(k, i)) - (1 - \alpha(k))\hat{G}(k, i-1) \tag{10}$$

$$\hat{G}^{+}(k, i) = \begin{cases} \hat{G}(k, i), & \text{if } \hat{G}(k, i) \geq \lambda \\ \lambda, & \text{if } \hat{G}(k, i) < \lambda \end{cases} \tag{11}$$

$$\hat{S}(k, i) = \hat{G}^{+}(k, i)M_0(k, i) \tag{12}$$

$$\begin{aligned} W_{ns}(n) &= s_1(n) + s_2(n) + n_w(n) \\ X_{ns}(n) &= s_1(n)\cos(\phi_1) + s_2(n)\cos(\phi_2) + n_x(n) \\ Y_{ns}(n) &= s_1(n)\sin(\phi_1) + s_2(n)\sin(\phi_2) + n_y(n) \\ U_{ns}(n) &= s_1(n)\cos(2\phi_1) + s_2(n)\cos(2\phi_2) + n_u(n) \\ V_{ns}(n) &= s_1(n)\sin(2\phi_1) + s_2(n)\sin(2\phi_2) + n_v(n) \end{aligned} \tag{13}$$

$$G_{ns}(k, i) = \frac{2 * \Re\,[X_{ns}(k, i)^H * U_{ns}(k, i)]}{|X_{ns}(k, i)^2| + |Y_{ns}(k, i)^2| + |U_{ns}(k, i)^2| + |V_{ns}(k, i)^2|} \tag{14}$$

$$\begin{aligned} W_{re}(k, i) &= B_{00}^{+1}(k, i) \\ X_{re}(k, i) &= B_{11}^{+1}(k, i) \\ Y_{re}(k, i) &= B_{11}^{-1}(k, i) \\ U_{re}(k, i) &= B_{22}^{+1}(k, i) \\ V_{re}(k, i) &= B_{22}^{-1}(k, i) \end{aligned} \tag{15}$$

The invention claimed is:

1. Method for spatial filtering of at least one sound signal (M.sub.0; W(n)), the method characterized in that it includes the following steps: generation of a first captured sound signal (23; M.sub.1; M.sub.1.sup.1, M.sub.1.sup.−1; X(n), Y(n)) by capturing of the at least one sound signal by a first microphone (12.sub.1), whereby the first microphone (12.sub.1) is characterized by a first directivity pattern; generation of a second captured sound signal (23; M.sub.2; M.sub.2.sup.1, M.sub.2.sup.−1; U(n), V(n)) by capturing of the at least one sound signal by a second microphone (12.sub.2), whereby the second microphone (12.sub.2) is characterized by a second directivity pattern; and generation of a third captured sound signal (23; M.sub.0; W(n)) by capturing of the at least one sound signal by a third microphone (12.sub.0), whereby the third microphone (12.sub.0) is characterized by a third directivity pattern; so that the first microphone (12.sub.1), the second microphone (12.sub.2) and the third microphone (12.sub.0) constitute one microphone array (12), characterized by a multiple of directivity patterns of different orders, whereby the first directivity pattern as well as the second directivity pattern and the third directivity pattern constitute respectively one particular directivity pattern of said multiple of directivity patterns of different orders; performing a short-time Fourier transformation of the captured sound signals (23; M.sub.0, M.sub.1, M.sub.2; M.sub.1.sup.1, M.sub.1.sup.−1, M.sub.2.sup.1, M.sub.2.sup.−1; X(n), Y(n), U(n), V(n), W(n)); measuring a cross-pattern correlation or a cross-pattern coherence as the correlation or coherence between two of the captured sound signals (23; M.sub.1, M.sub.2; M.sub.1.sup.1, M.sub.1.sup.−1, M.sub.2.sup.1, M.sub.2.sup.−1; X(n), Y(n), U(n), V(n)) having the positive-phase maximum in directivity response towards a desired look direction (.quadrature.) in each time frequency position; calculation of a gain factor (G.sup.+) for each time-frequency position using the cross-pattern correlation or the cross-pattern coherence based on time-averaged correlation or coherence between the first captured sound signal (23; M.sub.1; M.sub.1.sup.1, M.sub.1.sup.−1; X(n), Y(n)) and the second captured sound signal (23; M.sub.2; M.sub.2.sup.1, M.sub.2.sup.−1; U(n), V(n)) having equal phase for a same look direction; and applying the gain factor (G.sup.+) to the corresponding time-frequency positions in the third captured sound signal (23; M.sub.0; W(n)).

2. Method according to claim 1, wherein: the cross-pattern correlation or the cross-pattern coherence is used to define a correlation measure or coherence measure between the captured signals for the same look direction, i) where the measure of correlation or coherence is high i.e. exceeds a pre-defined threshold, and/or ii) where the first and second captured sound signals (23; $M_1$, $M_2$; $M_1^1$, $M_1^{-1}$, $M_2^1$, $M_2^{-1}$; X (n) Y(n), U(n), V(n)) have a directivity response of:

iia) high sensitivity i.e. exceeding a pre-defined threshold, and/or iib) equal phase, for the same look direction.

3. Method according to claim 1, wherein: the method is carried out for many or all possible look directions in order to define a look direction of optimal signal-to-spatial noise ratio for the first and second captured sound signals (23; $M_1$, $M_2$; $M_1^1$, $M_1^{-1}$, $M_2^1$, $M_2^{-1}$; X(n), Y(n), U(n), V(n)) a) at peak values of the measured cross-pattern correlation or the measured cross-pattern coherence and/or b) at maximum values of the measured cross-pattern correlation or cross-pattern coherence in each time-frequency position.

4. Method according to claim 1, wherein: the first and the second sound signal (23; $M_0$, $M_1$, $M_2$; $M_1^1$, $M_1^{-1}$, $M_2^1$, $M_2^{-1}$; X(n), Y(n), U(n), V(n), W(n)) are being captured and treated simultaneously.

5. Method according to claim 4, wherein: the first directivity pattern is equivalent to a directivity pattern of first order, and the second directivity pattern is equivalent to a directivity pattern of second order.

6. Method according to claim 1, further comprising the step of: normalizing the cross-pattern correlation or cross-pattern coherence to compensate for the magnitudes of the first and second captured signals (23; $M_1$, $M_2$; $M_0$, $M_1^1$, $M_1^{-1}$, $M_2^1$, $M_2^{-1}$; X(n), Y(n), U(n), V(n), W(n)), for instance, by normalizing by the energy of both captured signals (23; $M_0$, $M_1$, $M_2$; $M_0$, $M_1^1$, $M_1^{-1}$, $M_2^1$, $M_2^{-1}$; X(n), Y(n), U(n), V(n), W(n)).

7. Method according to claim 1, wherein: the gain factor ($G^{\hat{}+}$) depends on a cross-pattern correlation, a cross-pattern coherence, the normalized cross-pattern correlation, or normalized cross-pattern coherence, any of which being time averaged to eliminate signal level fluctuations and to obtain a normalized gain factor.

8. Method according to claim 1, wherein: the gain factor ($G^{\hat{}+}$) is half-wave rectified in order to obtain a unique beamformer at the desired look direction (□).

9. Method according to claim 1, wherein: the gain factor ($G^{\hat{}+}$) is applied to a third sound signal (23; $M_0$; W(n)) stream captured by the third microphone ($\mathbf{12}_0$) imposing the directivity dependent gain on the third microphone signal (23; $M_0$; W(n)), thereby selectively attenuating input from directions with a low correlation or coherence measure i.e. a cross-pattern correlation or cross-pattern coherence measure that is below a predefined threshold.

10. Method according to claim 1, wherein: the method is carried out in real-time during a meeting or teleconference.

11. Method according to claim 1, wherein: the applying of the gain factor ($G^{\hat{}+}$) to the corresponding time-frequency positions in the third captured sound signal (23; $M_0$; W(n))

is performed on captured signals (23; $M_0$, $M_1$, $M_2$; $M_0$, $M_1^1$, $M_1^{-1}$, $M_2^1$, $M_2^{-1}$; X(n), Y(n), U(n), V(n), W(n)) stored in a database (91) or other data repository.

12. Method according to claim 1, wherein: the desired look direction (□) may be entered or selected manually or automatically.

13. Computer readable storage medium, holding one or more sequence of instructions for a machine or computer to carry out the method according to claim 1 with at least the first microphone ($\mathbf{12}_1$), the second microphone ($\mathbf{12}_2$) and the third microphone ($\mathbf{12}_0$).

14. Spatial filtering system based on cross-pattern coherence comprising: acoustic streaming inputs for a microphone array (12) with at least a first microphone (12.sub.1), a second microphone (12.sub.2), and a third microphone (12.sub.0) and an analysis module (10, 11, CPCM) configured to perform the steps: generation of a first captured sound signal (23; M.sub.1; M.sub.1.sup.1, M.sub.1.sup.−1; X(n), Y(n)) by capturing of at least one sound signal by the first microphone (12.sub.1), whereby the first microphone (12.sub.1) is characterized by a first directivity pattern; generation of a second captured sound signal (23; M.sub.2; M.sub.2.sup.1, M.sub.2.sup.−1; U(n), V(n)) by capturing of the at least one sound signal by the second microphone (12.sub.2), whereby the second microphone (12.sub.2) is characterized by a second directivity pattern; generation of a third captured sound signal (23; M.sub.0; W(n)) by capturing of the at least one sound signal by a third microphone (12.sub.0), whereby the third microphone (12.sub.0) is characterized by a third directivity pattern; so that the first microphone (12.sub.1), the second microphone (12.sub.2) and the third microphone (12.sub.0) constitute one microphone array (12), characterized by a multiple of directivity patterns of different orders, whereby the first directivity pattern as well as the second directivity pattern and the third directivity pattern constitute respectively one particular directivity pattern of said multiple of directivity patterns of different orders, performing a short-time Fourier transformation of the captured sound signals (23; M.sub.0, M.sub.1, M.sub.2; M.sub.1.sup.1, M.sub.1.sup.−1, M.sub.2.sup.1, M.sub.2.sup.−1; X(n), Y(n), U(n), V(n), W(n)); measuring a cross-pattern correlation or a cross-pattern coherence as the correlation or coherence between two of the captured sound signals (23; M.sub.0, M.sub.1, M.sub.2; M.sub.1.sup.1, M.sub.1.sup.−a1, M.sub.2.sup.1, M.sub.2.sup.−1; X(n), Y(n), U(n), V(n), W(n)) having the positive-phase maximum in directivity response towards a desired look direction (.quadrature.) in each time frequency position; calculation of a gain factor (G.sup.+) for each time-frequency position using the cross-pattern correlation or the cross-pattern coherence based on time-averaged correlation or coherence between the first captured sound signal (23; M.sub.1; M.sub.1.sup.1, M.sub.1.sup.−1; X(n), Y(n)) and the second captured sound signal (23; M.sub.2; M.sub.2.sup.1, M.sub.2.sup.−1; U(n), V(n)) having equal phase for a same look direction; and applying the gain factor (G.sup.+) to the corresponding time-frequency positions in the third captured sound signal (23; M.sub.0; W(n)).

15. System according to claim 14, wherein: the analysis module (CPCM) uses the cross-pattern correlation or the cross-pattern coherence to define a correlation or coherence measure between the captured signals for the same look direction, i) where the measure of correlation or coherence is high i.e. exceeds a pre-defined threshold, and/or ii) where the first and second captured sound signals (23; $M_1$, $M_2$; $M_1^1$, $M_1^{-1}$, $M_2^1$, $M_2^{-1}$; X(n), Y(n), U(n), V(n)) have a directivity response of:

iia) high sensitivity i.e. exceed a pre-defined threshold, and/or iib) equal phase.

16. System according to claim 15, wherein: the analysis module (CPCM) is configured to calculate gain factors ($G^{\hat{}+}$) for many or all possible look directions in order to define a look direction of optimal signal-to-spatial noise ratio for the first and second microphone ($\mathbf{12}_1$, $\mathbf{12}_2$) a) at peak values of the measure of coherence or of the measure of correlation and/or b) at maximum values of the measured cross-pattern correlation or coherence in each time-frequency position.

17. System according to claim 14, wherein: the first and second sound signal (23; $M_0$, $M_1$, $M_2$; $M_1^1$, $M_1^{-1}$, $M_2^1$, $M_2^{-1}$; X(n), Y(n), U(n), V(n), W(n)) are captured and treated simultaneously.

18. System according to claim 17, wherein: the first directivity pattern is equivalent to a directivity pattern of first order, and the second directivity pattern is equivalent to a directivity pattern of second order.

19. System according to claim 14, wherein: the analysis module (CPCM) has been configured to normalize the cross-pattern correlation or the cross-pattern coherence to compensate for the magnitudes of the first and second captured signals (23; $M_0$, $M_1$, $M_2$; $M_1^1$, $M_1^{-1}$, $M_2^1$, $M_2^{-1}$; X (n), Y(n), U(n), V(n), W(n)), for instance, by normalizing by the energy of both captured signals (23; $M_0$, $M_1$, $M_2$; $M_1^1$, $M_1^{-1}$, $M_2^1$, $M_2^{-1}$; X(n), Y(n), U(n), V(n), W(n)).

20. System according to claim 14, wherein: the analysis module (CPCM) time averages the gain factor ($G^{\hat{}+}$) depending on the cross-pattern correlation or cross-pattern coherence or the normalized cross-pattern correlation or coherence to eliminate signal level fluctuations and to obtain a normalized gain factor.

21. System according to claim 14, wherein: the analysis module (CPCM) half-wave rectifies the gain factor ($G^{\hat{}+}$) in order to obtain a unique beamformer at the desired look direction (□).

22. System according to uric of claim 14, wherein: a synthesis module applies the gain factor ($G^{\hat{}+}$) to a sound signal (23; $M_0$, $M_1$, $M_2$; $M_1^1$, $M_1^{-1}$, $M_2^1$, $M_2^{-1}$; X(n), Y(n), U(n), V(n), W(n)) stream captured by a microphone ($\mathbf{12}_1$, $\mathbf{12}_2$, $\mathbf{12}_0$, 12) imposing the gain dependent on direction on the corresponding sound signal (23; $M_0$, $M_1$, $M_2$; $M_1^1$, $M_1^{-1}$, $M_2^1$, $M_2^{-1}$; X (n), Y(n), U(n), V(n), W(n)), thereby selectively attenuating input from directions with low coherence or low correlation measure.

23. System according to claim 17, further comprising: an equalization module (CPCM) equalizing the first captured signal (23; $M_1$; $M_1^1$, $M_1^{-1}$; X(n), Y(n)) and second captured signal (23; $M_2$; $M_2^1$, $M_2^{-1}$; U(n), V(n)) to both have the same phase and magnitude responses before the analysis module calculates the gain factor ($G^{\hat{}+}$).

24. System according to claim 14 to 23, wherein: the system is comprised in a teleconference apparatus comprising an array (12) of microphones ($\mathbf{12}_1$, $\mathbf{12}_2$, $\mathbf{12}_0$) or connected to the same, and configured to apply the gain factor ($G^{\hat{}+}$) to the corresponding time-frequency positions in the third captured sound signal (23; $M_0$; W(n)) real-time during a meeting or teleconference.

25. System according to claim 14, wherein: the system comprises a database (91) or other data repository and is configured or configurable to apply the gain factor ($G^{\hat{}+}$) to the corresponding time-frequency positions in the third captured sound signal (23; $M_0$; W(n)) on captured signals (23; $M_0$, $M_1$, $M_2$; $M_0$, $M_1^{-1}$, $M_2^{-1}$, $M_2^{1}$, $M_2^{-1}$; X(n), Y(n), U(n), V(n), W(n)) that have been stored in the database (91) or in the other data repository.

26. System according to claim 14 wherein: the system further comprises a means for manually or automatically entering or selecting the desired look direction (□).

* * * * *